US007408427B1

(12) United States Patent
Lee-Yow et al.

(10) Patent No.: US 7,408,427 B1
(45) Date of Patent: Aug. 5, 2008

(54) COMPACT MULTI-FREQUENCY FEED WITH/WITHOUT TRACKING

(75) Inventors: Clency Lee-Yow, Longmont, CO (US); Jonathan Raymond Scupin, Longmont, CO (US); Philip Elwood Venezia, Longmont, CO (US)

(73) Assignee: Custom Microwave, Inc., Longmont, CO (US)

( * ) Notice: Subject to any disclaimer, the term of this patent is extended or adjusted under 35 U.S.C. 154(b) by 356 days.

(21) Appl. No.: 11/270,861

(22) Filed: Nov. 9, 2005

Related U.S. Application Data

(60) Provisional application No. 60/627,264, filed on Nov. 12, 2004.

(51) Int. Cl.
*H01P 5/12* (2006.01)

(52) U.S. Cl. ..... 333/126; 333/135; 333/137; 333/21 A; 333/21 R

(58) Field of Classification Search ..... 333/126, 333/129, 134, 135, 137, 21 A, 21 R
See application file for complete search history.

(56) References Cited

U.S. PATENT DOCUMENTS 4,176,330 A * 11/1979 DiTullio et al. ..... 333/122
4,228,410 A 10/1980 Goudey et al. ..... 333/122
6,661,309 B2 12/2003 Chen et al. ..... 333/126
6,700,548 B1 3/2004 Chen et al. ..... 343/771
6,847,270 B2 * 1/2005 Yoneda et al. ..... 333/135

OTHER PUBLICATIONS

Product Description Literature, Victory Microwave Corporation, 2 pages, accessed at www.vicmic.com.tw/mic_product/sat/ka_band_dual.pdfon Nov, 8, 2005.

* cited by examiner

*Primary Examiner*—Robert J. Pascal
*Assistant Examiner*—Kimberly E Glenn
(74) *Attorney, Agent, or Firm*—Rick Martin; Patent Law Offices of Rick Martin, P.C.

(57) ABSTRACT

A method and apparatus forming an efficient and compact waveguide feed with all components for processing signals in multi-frequency band antenna feeds with single/dual linear/circular polarizations with/without tracking. The layout can be realized in a split block configuration using any number of fabrication methods, such as brazing, electroforming, and machining and is most effective when it is realized in a split-block construction, in which the waveguide components are formed in the recesses split about the zero current line. This layout results in a very compact feed, which has excellent electrical characteristics, is mechanically robust, eliminates flange connections between components, and is very cost effective.

20 Claims, 24 Drawing Sheets

COMPACT MULTI-FREQUENCY FEED WITH/WITHOUT TRACKING

CROSS REFERENCE APPLICATIONS

This application is a non-provisional application claiming the benefits of provisional application No. 60/627,264 filed on Nov. 12, 2004.

FIELD OF THE INVENTION

The present invention relates to an efficient and compact layout of waveguide components for processing signals in multi-frequency band antenna feeds with single/dual linear/circular polarizations with/without tracking.

BACKGROUND OF THE INVENTION

Microwave signals are extremely high frequency (HF) signals, usually in the gigahertz range. They are used to transmit large amounts of video, audio, RF, telephone, and computer data over long distances. They are used in commercial and military applications, including communications to satellites, airplanes and the like. Frequencies are divided into various bands such as the S-band (2-3.5 GHz), Ku-band (10.7-18 GHz), Ka-band (18-31 GHz), and others such as the X-band etc.

Polarization is a characteristic of the electromagnetic wave. Four types of polarization are used in satellite and other transmissions: horizontal; vertical; right-hand circular (RHCP); and left-hand circular (LHCP). Horizontal and vertical polarizations are types of linear polarizations. Linear and circular polarizations are well known in the art. An example of linear polarization is shown in FIG. 1A. A wave is made up of an electric field 'E' and a magnetic field 'M'. When a wave of wavelength 'k' is transmitted into free space from an antenna, the orientation of its electric field E with respect to the plane of the earth's surface determines the polarization of the wave. If the wave is oriented such that the E field is perpendicular to the earth, the wave is referred to as vertically polarized. If the 'E' field is parallel to the earth's surface, the wave is horizontally polarized, which is the orientation of the 'E' field shown in FIG. 1A. Also shown is the magnetic field 'M'. In both of these cases, the wave polarization remains in the same orientation at all times and is, therefore, referred to as linear polarization. The wave travels in direction 'C' along the X-axis.

FIG. 1B depicts the alternative to linear polarization, referred to as circular polarization. In this kind of electromagnetic emission, the 'E' field is no longer confined to a single plane, but consists of equal-amplitude horizontally and vertically polarized components, which are phase-shifted by 90°. It can be readily seen that the vectors of both the 'E' and 'M' fields are rotating in a clockwise direction (if viewed from behind an antenna). This rotation is called RHCP. For every cycle of the transmitted wave, the 'E' and 'M' fields will rotate a full 360°. An observer (standing behind the antenna) would "see" the rotation vector in this drawing rotating in a circular clockwise motion R and moving in direction C along the X-axis. The type of polarization is controlled by the design of the antenna feed assembly.

Multi-frequency band feeds exist that have the ability to send/receive more than one frequency and are usually designed for frequency bandwidths within one or more of the aforementioned bands.

A typical multi-frequency band feed without tracking (prior art) is shown in the block diagram of FIG. 2A and consists of a waveguide assembly 20A with the following components:

1. Multi-frequency band horn 22 to produce the desired radiation pattern characteristics, where an input signal is received or an output signal is transmitted.
2. Behind the horn, first common junction 24 with appropriate filters is used to separate out the two orthogonal linear polarizations of the lowest frequency band without impacting any of the higher frequency bands. Filters include first low pass filter 26 (LF filter) to filter the lowest frequency range and first high pass filter 36 (HF filter) to filter the higher frequency ranges. If circular polarization is required, first 90° polarizer 28 (low frequency (LF) polarizer) attaches to both first (LF) waveguide port right hand circular polarization (RHCP) 32 and LF waveguide port left hand circular polarization (LHCP) 34. Ports 32, 34 can also be used for horizontal or vertical polarization respectively if circular polarization is not required. In this case the 90° polarizer 28 is not required.
3. Second common junction 38 with appropriate filters is used to separate out the two orthogonal linear polarizations of the next lowest frequency band without impacting any of the higher frequency bands. Filters include second low pass filter 42 to filter the second lowest frequency range and second high pass filter 52 to filter the next higher frequency range. If circular polarization is required, second 90° polarizer 44 attaches to both second waveguide port RHCP 46 and second waveguide port LHCP 48. Additional common junctions, not shown, are added for additional frequency band requirements. Ports 46,48 will also be used for horizontal or vertical polarization respectively if circular polarization is not required. In this case second 90° polarizer 44 is not required.
4. An Ortho-Mode Transducer (OMT) is used after the last common junction to separate the two orthogonal linear polarizations of the highest frequency bands. If circular polarization is required, a polarizer can be used immediately in front of the OMT. A combined OMT/Polarizer 54 (e.g. a Septum Polarizer) is shown instead of a separate OMT and polarizer. OMT/Polarizer 54 comprises high frequency RHCP port 56 and high frequency LHCP port 58.
5. A four port feed would have one common junction whereas a six port feed would have two common junctions and so forth.
6. If a dual band feed were used, then OMT/Polarizer 54 would be placed after the first common junction and first high pass filter.
7. If additional frequency bands are present, OMTs, OMT/Polarizers, or more junctions are used in the proper sequence as described above to separate higher frequency bands.
8. If tracking is required, aforementioned waveguide assembly 20A is modified to waveguide assembly 20B as shown in FIG. 2B. This modification adds a higher order mode coupler (e.g. TE21 or TM01) 25 placed between the Multi-frequency band horn 22 and the first common junction 24, to extract a difference signal 23 used for tracking purposes. All other functions depicted in FIG. 2B are as described above for FIG. 2A.

Further references to a multi-frequency feed as noted herein imply a feed with single/dual linear/circular polarizations with/without tracking. The term "microwave" refers to signals with a frequency ranging from 1 giga hertz to 1,000 giga hertz.

The traditional way of producing a multi-frequency band feed system is to produce each component separately, and join them together by use of flanges, brazing or other techniques. An assembly of separate components can be expensive to produce, requires more space, and demands many flange connections, which can degrade the performance of the system.

Prior art of feed system designs are illustrated and described in U.S. Pat. No. 4,228,410 issued Oct. 14, 1980 to Kenneth R. Goudey, assigned to Ford Aerospace and Communications Corporation. Another design is illustrated and described in U.S. Pat. No. 6,700,548 B1 issued Mar. 2, 2004 to Ming Hui Chen, assigned to Victory Industrial Corporation.

The problem with the prior art feed U.S. Pat. No. 4,228,410 is that it requires many components, which result in a very long feed (several feet long for C-band) and is not cost effective to manufacture because of the complexity of the individual components. The large number of flange connections can also cause negative effects on electrical performances.

The problem with prior art feed U.S. Pat. No. 6,700,548 B1 is that the layout still results in a long feed. The assembly is made by joining four separate sections, which are not necessarily joined along the zero current line. Failure to join components along the zero current line can result in degraded electrical performance.

Large physical size of a feed assembly is a problem for many applications including satellites, airplanes, military craft, etc. The present invention solves the problems of size, for example the present invention would reduce the size of a C-band waveguide from over several feet long to less than one foot long. The present invention provides for ease of manufacture and optimizes the efficiency with respect to signal losses.

SUMMARY OF THE INVENTION

The main aspect of the present invention is to provide an efficient selection and layout of waveguide components for multi-frequency band antenna feeds.

Another aspect of the present invention is to provide an apparatus such that components can be machined (or otherwise manufactured) in a split block configuration.

Another aspect of the present invention is that it be applied to waveguide components with circular, rectangular, square, elliptical, co-axial, or any cross sections that can be created by making recesses in the split block.

Yet another aspect of the current invention is that the created blocks are joined at the zero current line of the components.

Another aspect of the present invention is very significant size reduction (especially axial length) realized by the proper choice and combination of waveguide components, which results in an efficient layout.

Another aspect of the current invention is the elimination of the need for flanges between different components.

Another aspect of the present invention is that the split block fabrication technique allows very cost effective manufacturing both during fabrication and assembly.

Another aspect of the present invention is that there is no limit to the frequency bands that can be applied to it as long as a practical method of fabrication is available.

Another aspect of the present invention is to provide a waveguide that can be manufactured with various fabrication methods, such as brazing, electroforming, machining, etc.

Yet another aspect of the present invention is that the layout provides the ability to incorporate waveguide components such as a mode coupler for extracting higher order modes for tracking purposes. These components although different in function are incorporated in a similar compact manner to the components for frequency band separation.

The present invention provides an efficient layout of waveguide components for multi-frequency band antenna feeds. It allows for compaction of components, maintains good electrical performance, is mechanically robust, eliminates flange connections between components, and is very cost effective to produce in small or large quantities.

The present invention allows waveguide components that can be machined in a split block configuration. The waveguide component(s) is/are produced by creating recesses in two pieces of material. The component(s) is/are formed after assembly of each split block. Assembly of the blocks can be done by any method that can effectively hold the blocks together such as bolts, brazing, soldering, and bonding. This process is very cost effective and significantly reduces the size of multi-frequency band antenna feeds.

The current invention is most effective when realized in a split block manufacture and assembly to create the unique structures used in multi-frequency band antenna feeds. For a dual frequency band feed only three blocks are required. A tri-band feed requires an assembly of four blocks. If tracking is required, an additional block assembly would be required between the horn and the first common junction. This technique can be used for as many unique frequency bands as are desired by the application for which they are intended for use. The present invention can be realized using any number of fabrication methods, such as brazing, electroforming, machining, etc.

Other aspects and advantages of the invention will become apparent from a consideration of the ensuing detailed description, drawings and appended claims, reference being made to the accompanying drawings forming a part of this specification wherein like reference characters designate corresponding parts in the several views.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF DRAWINGS

The present invention provides an efficient selection and layout of waveguide components for multi-frequency band antenna feeds. Optimization of layout eliminates components otherwise needed in prior art configurations. The layout of components in a systematic fashion starting from the horn input area and progressing from the lowest frequency to the next highest frequency, and so forth, results in an optimization of layout, and the number of components required. This process leads to the ability to manufacture an apparatus such that components can be machined (or otherwise manufactured) in a split block configuration or produced by other manufacturing means including brazing, electroforming, machining, etc.

The optimization of layout is most effective and is able to be totally produced in a split-block construction, in which the waveguide components are formed in the recesses split about the zero current line. This layout results in a very compact feed, which has excellent electrical characteristics, is mechanically robust, eliminates flange connections between components, and is very cost effective to produce. An embodiment of the present invention will be described herein with a dual frequency, four port layout.

Figure 1B:
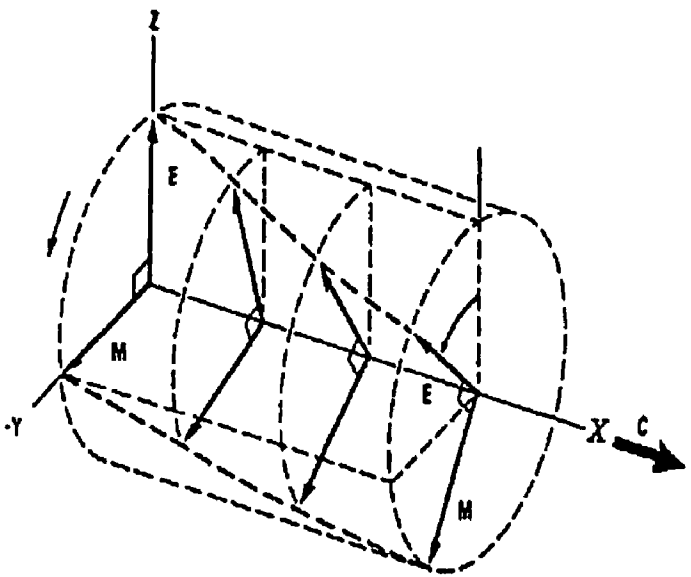
Figure 1B (prior art)
FIG. 1B is a prior art xyz plane view of a right handed circular polarization.
Figure 1A:
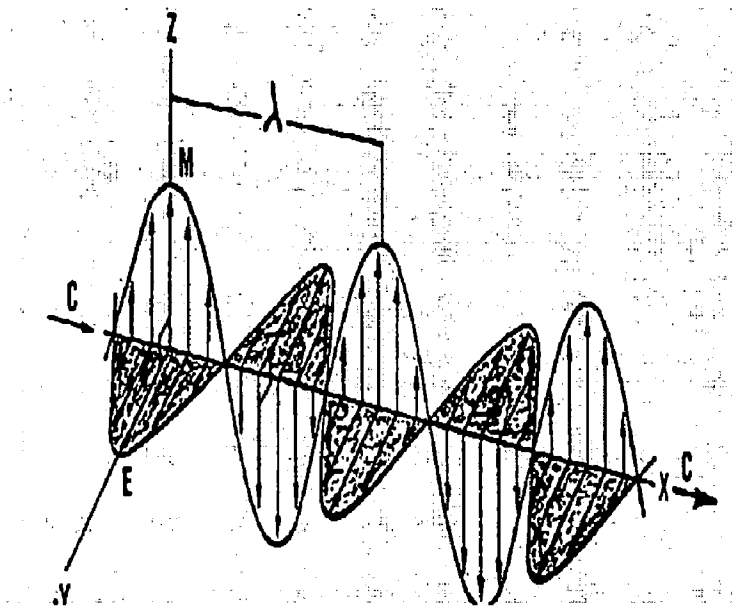
Figure 1A (prior art)
FIG. 1A is a prior art xyz plane view of a linearly polarized wave.
Figure 2A:
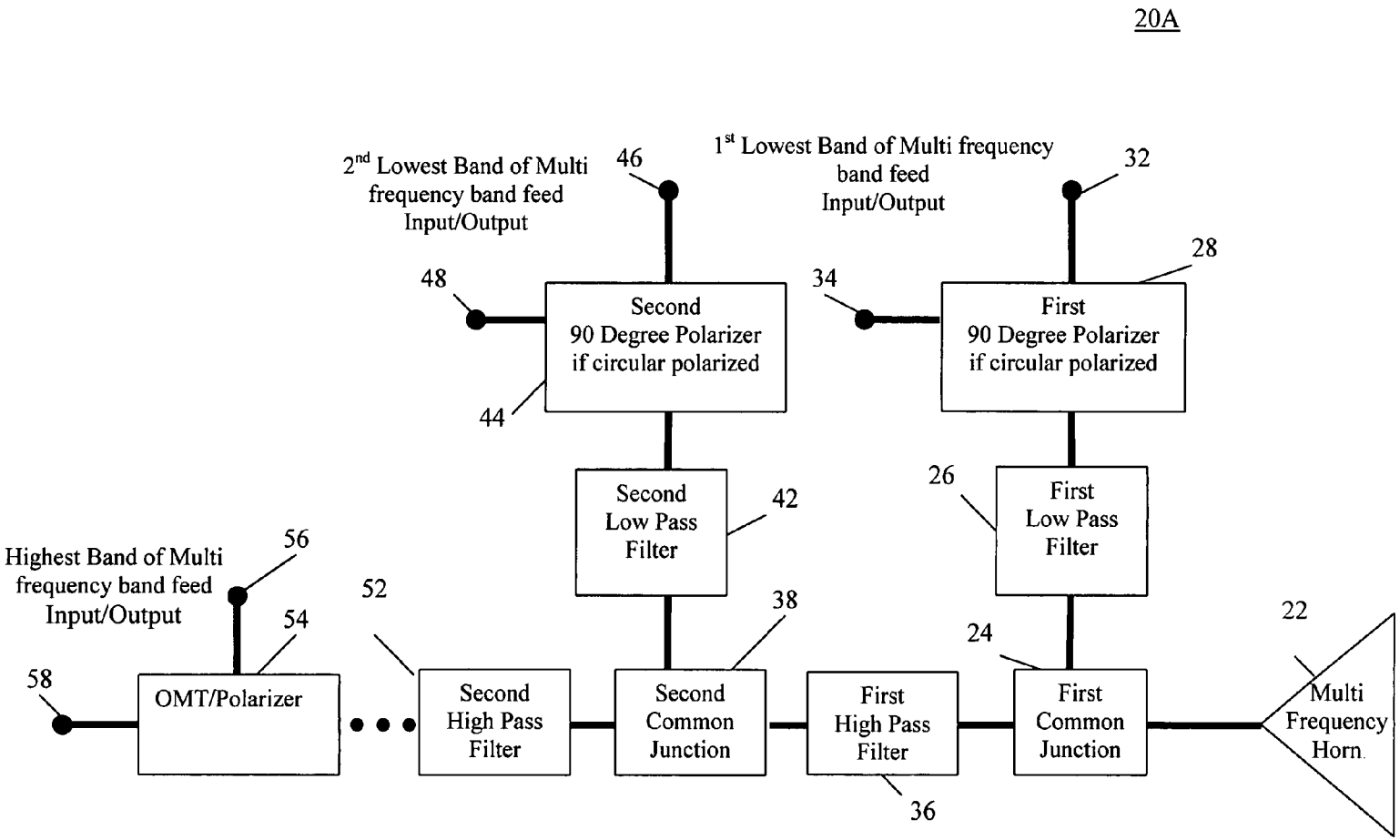
Figure 2A (prior art)
FIG. 2A is a prior art block diagram showing the components of a multi-frequency band antenna feed without tracking.
Figure 2B:
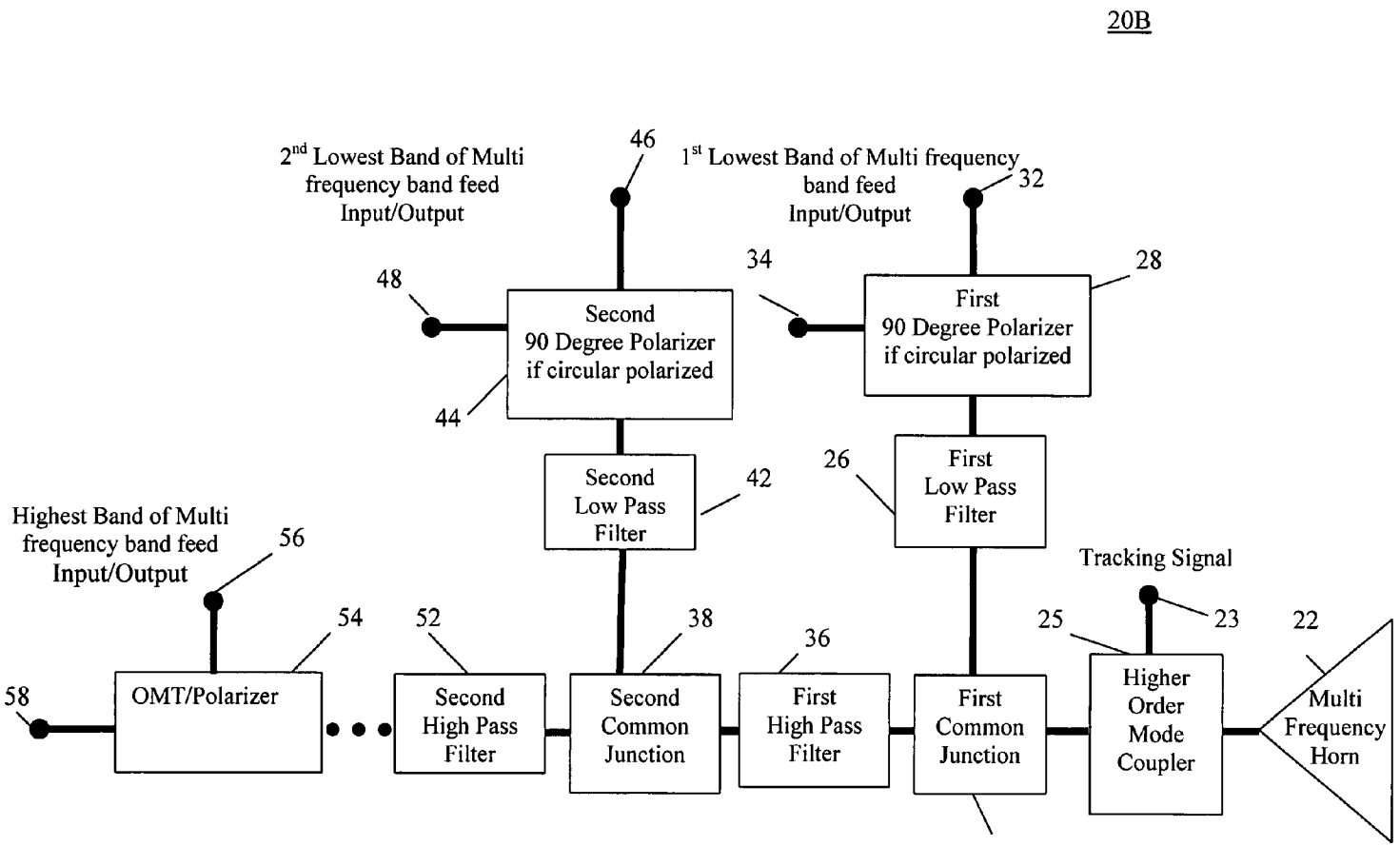
Figure 2B (prior art)
FIG. 2B is a prior art block diagram showing the components of a multi-frequency band antenna feed with tracking.
Figure 3:
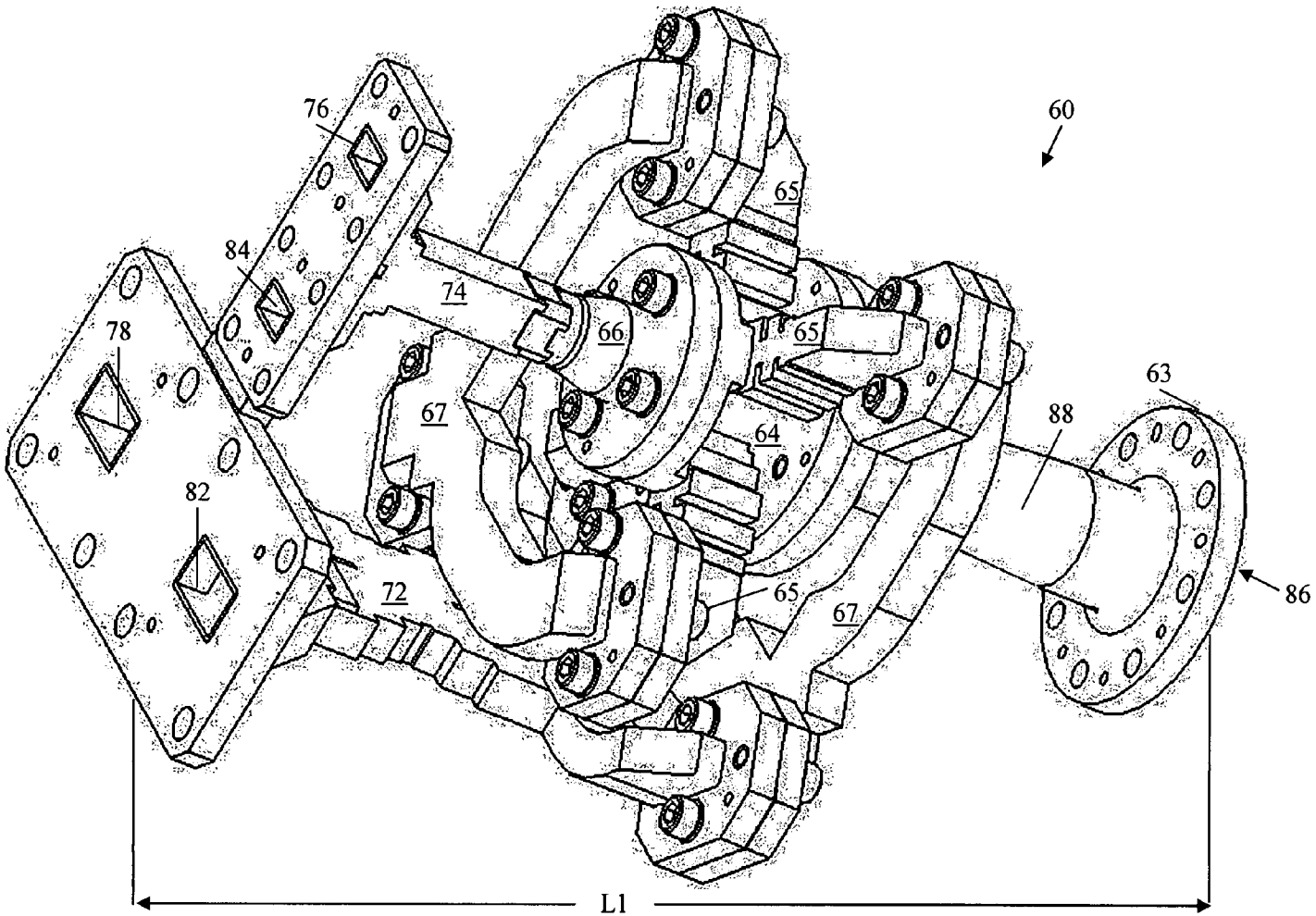
Figure 3 (prior art)
FIG. 3 is a perspective view of a prior art waveguide feed assembly.

For comparison, a prior art layout of a typical waveguide feed assembly 60 of a four-port waveguide feed is shown as a perspective view in FIG. 3. The waveguide feed can either transmit or receive microwave signals. The functions are as previously described in FIG. 2A. The feed assembly consists of the horn (not shown), where an input signal is received or an output signal is transmitted. The horn is attached to flange 63. Signals are transmitted or received through horn input/output area 86. For an input signal, horn taper area 88 feeds a polarized input signal into first common junction 64, which also contains first low pass filters 65, only three of the four first low pass filters 65 are visible. Visible is the first high pass filter 66. Tee sections 67 recombine both wave polarizations for the lowest frequency signal. The lowest frequency signal then moves through first 90° polarizer 72. The 90° polarizer allows a 90° phase shift for circularly polarized signals. The signal then goes to receiver electronics through low frequency (LF) RHCP port 78 or LF LHCP port 82. For vertical or horizontal polarization, 90° polarizer 72 is not required. High pass filter 66 moves the higher frequency through second 90° polarizer/OMT 74 and out through HF RHCP port 76 or HF LHCP port 84. For vertical or horizontal polarization, second 90° polarizer/OMT 74 is replaced by a simple OMT. At a junction you can have two orthogonal polarizations, vertical and horizontal. A junction is used to obtain a power split or a power recombination of two orthogonal linear polarizations. The vertical polarization signal travels through one pair of low pass filters thus each filter is getting a power split of the vertical polarization. The signal is recombined with a Tee section to restore it to the full power of the vertical polarization signal. Likewise, the horizontal polarization travels through the other pair of low pass filters and is combined to get the full signal of the horizontal polarization. Thus a junction is separating the vertical and horizontal polarizations and a Tee section is recombining signals. Prior art waveguide feed assembly 60 has axial length L1.

As can be seen in FIG. 3, there are various subassemblies with flanges and mounting bolts that add to the complexity of prior art waveguide feeds. This, in turn, adds to the cost of manufacture and assembly, and also adds to the physical size of waveguide feeds of prior art. The preferred embodiment of the present invention as described herein is compared to the prior art of FIG. 3.

An embodiment of the present invention is described below and comprises:

a) a first common junction;

b) a lowest frequency modular area with lowest frequency components comprising: a lowest frequency filter, lowest frequency polarizers, a lowest frequency magic tee (hybrid tee), and lowest frequency ports;

c) a second junction to move the next higher frequency signals to a higher frequency filter with a modular area comprising: a next higher frequency filter, next higher frequency polarizers, a next higher frequency magic tee (hybrid tee), and next higher frequency ports;

d) if required, a third junction to move the next higher frequency signals to a higher frequency filter and a third modular area is added and so forth until the number of required frequency modular areas are included in the layout;

e) wherein all components of a,b,c,d are built in a modular split block configuration.

Figure 4A:
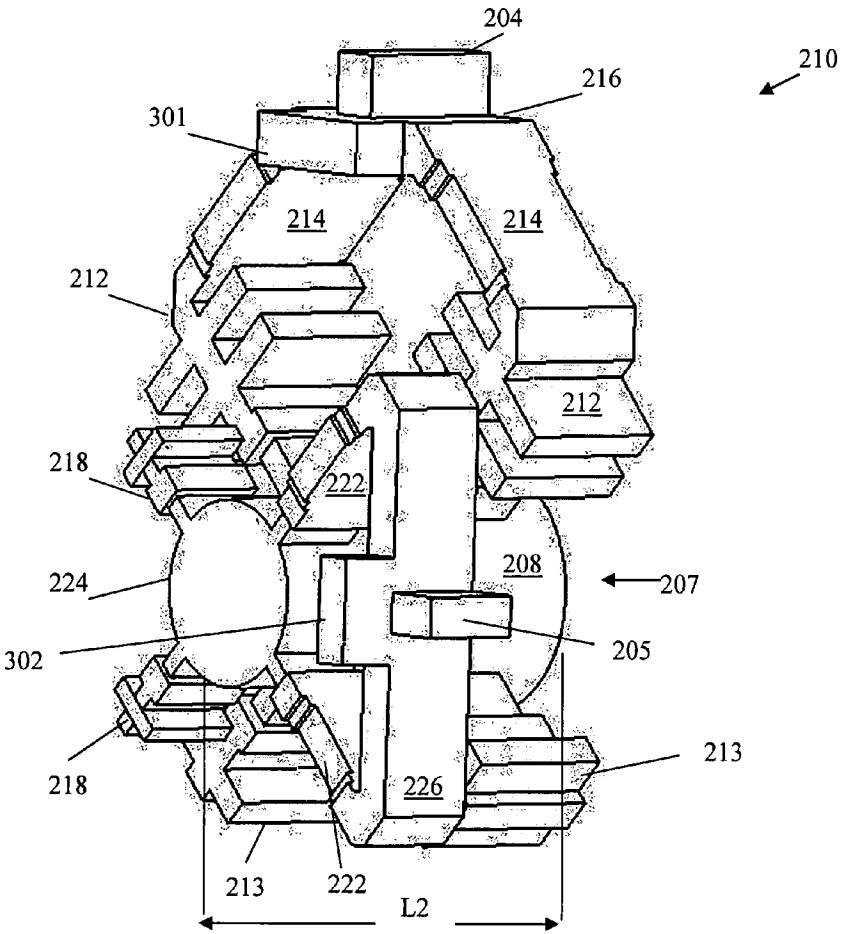
FIG. 4A is a solid rear left side perspective view of the assembly of the multi-frequency waveguide internal structure for an embodiment of the present invention.
Figure 4B:
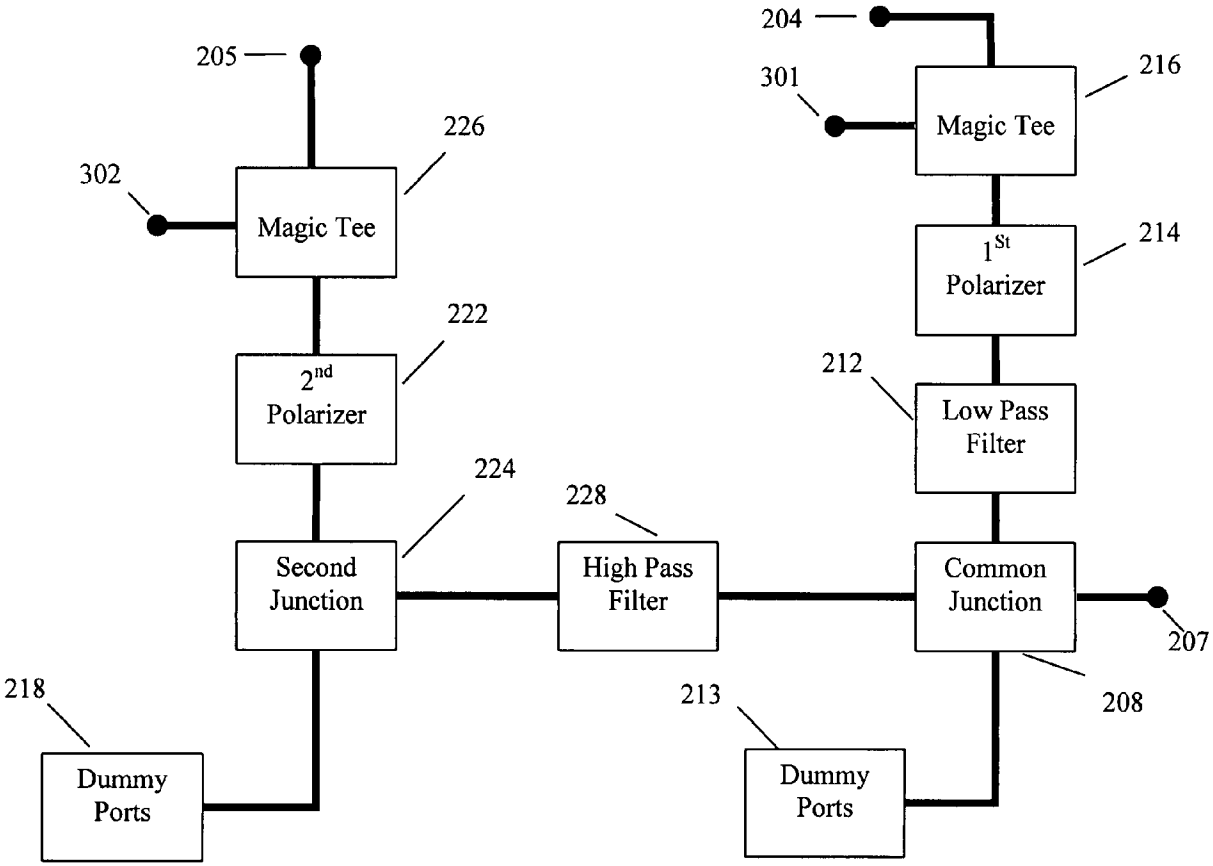
FIG. 4B is a simplified block diagram of the assembly of the multi-frequency waveguide internal structure of FIG. 4A.

FIG. 4A is a solid rear left side perspective view of the assembly of the multi-frequency waveguide internal structure 210, an embodiment of the present invention, having two separate frequency sections. A simplified block diagram of multi-frequency waveguide internal structure 210 is found in FIG. 4B. Multi-frequency waveguide internal structure 210 will be shown later in a three sectional split block configuration. It can be seen how the present invention provides a compact internal structure as a waveguide feed to transmit and/or receive microwave signals. The path will be described as receiving signals into horn input/output area 207 and exiting to receiver electronics within one of the four ports described herein. Multi-frequency internal structure 210 comprises horn input/output area 207, where an input signal is received or an output signal is transmitted. An input signal passes into first common junction 208, and into LF filters 212 as polarized. The lowest frequency signal then moves through LF 90° polarizer 214. LF 90° polarizer 214 allows a 90° phase shift that is necessary for circularly polarized signals. Magic tee (hybrid tee) section 216 recombines the two orthogonal components for the lowest frequency signal. Magic tee (hybrid tee) 216 is a four port, 180 degree hybrid splitter, realized in a waveguide. The signal then goes to receiver electronics through LF RHCP port 301 or LF LHCP port 204. For linear polarization, polarizer 214 and magic tee (hybrid tee) 216 are not needed. In this case, vertical and horizontal polarization ports would be placed directly after each LF filter 212, extended to the sidewall of the split block. Dummy ports 213 are connected to common junction 208 when a symmetrical structure is needed to eliminate unwanted modes and to help axial ratio. Junction 224 moves higher frequency signals to HF filtering section 228, which can be seen in FIG. 4C, and then to HF 90° polarizer 222. Dummy ports 218 are also connected to the junction and are required when a symmetrical structure is needed to eliminate unwanted modes and to help axial ratio. The two orthogonal components of the HF signal are recombined by magic tee (hybrid tee) 226 and then exit out through HF RHCP port 302 or HF LHCP port 205. For linear polarization, polarizer 222 and magic tee (hybrid tee) 226 are not needed.

In this case, vertical and horizontal polarization ports would be placed directly after HF junction 224, extended to the sidewall of the split block. Multi-frequency waveguide internal structure 210 has axial length L2.

As can be seen on FIG. 4A, the present invention provides a compact subassembly without flanges or mounting bolts that add to the complexity of prior art waveguide feeds. This reduces the cost of manufacture and assembly, and also reduces the physical size of the waveguide feed. Multi-frequency waveguide internal structure 210 can easily be sectioned in a three split block configuration for ease of manufacture, which is described below. It should be noted that a dual band four-port waveguide feed is described but this layout can easily be expanded to accommodate additional frequency bands and associated waveguide ports.

Figure 4C:
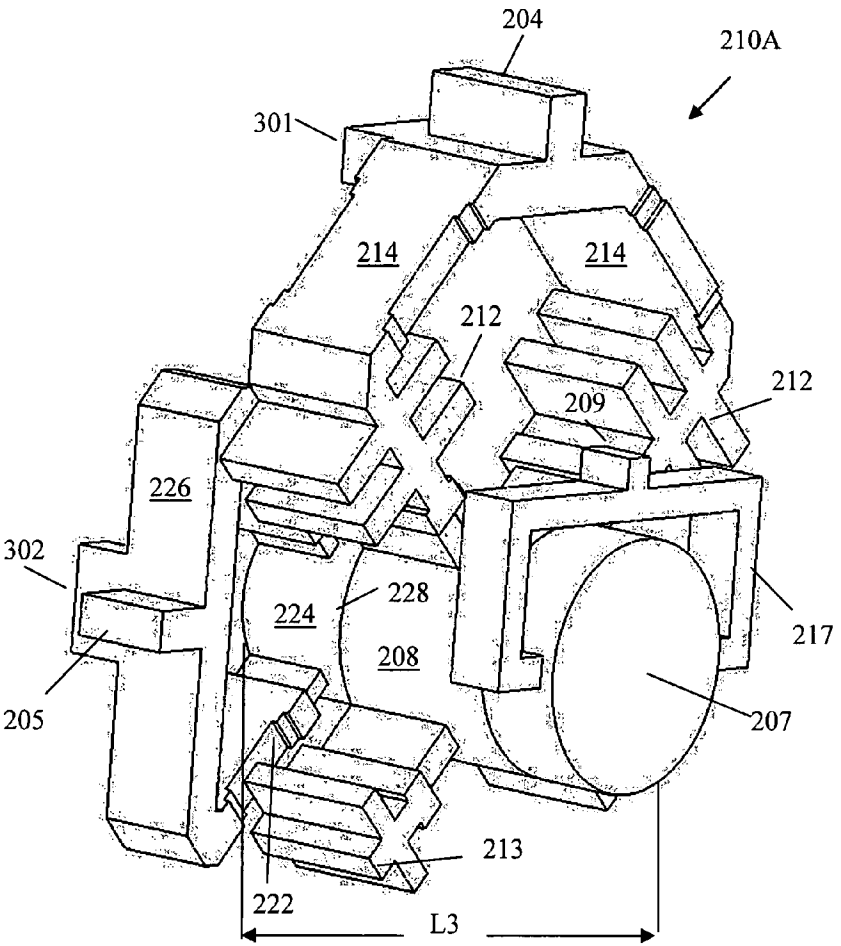
FIG. 4C is a solid front left side perspective view of the assembly of the multi-frequency waveguide internal structure, with a higher order mode coupler added for tracking, an additional embodiment of the present invention.
Figure 4D:
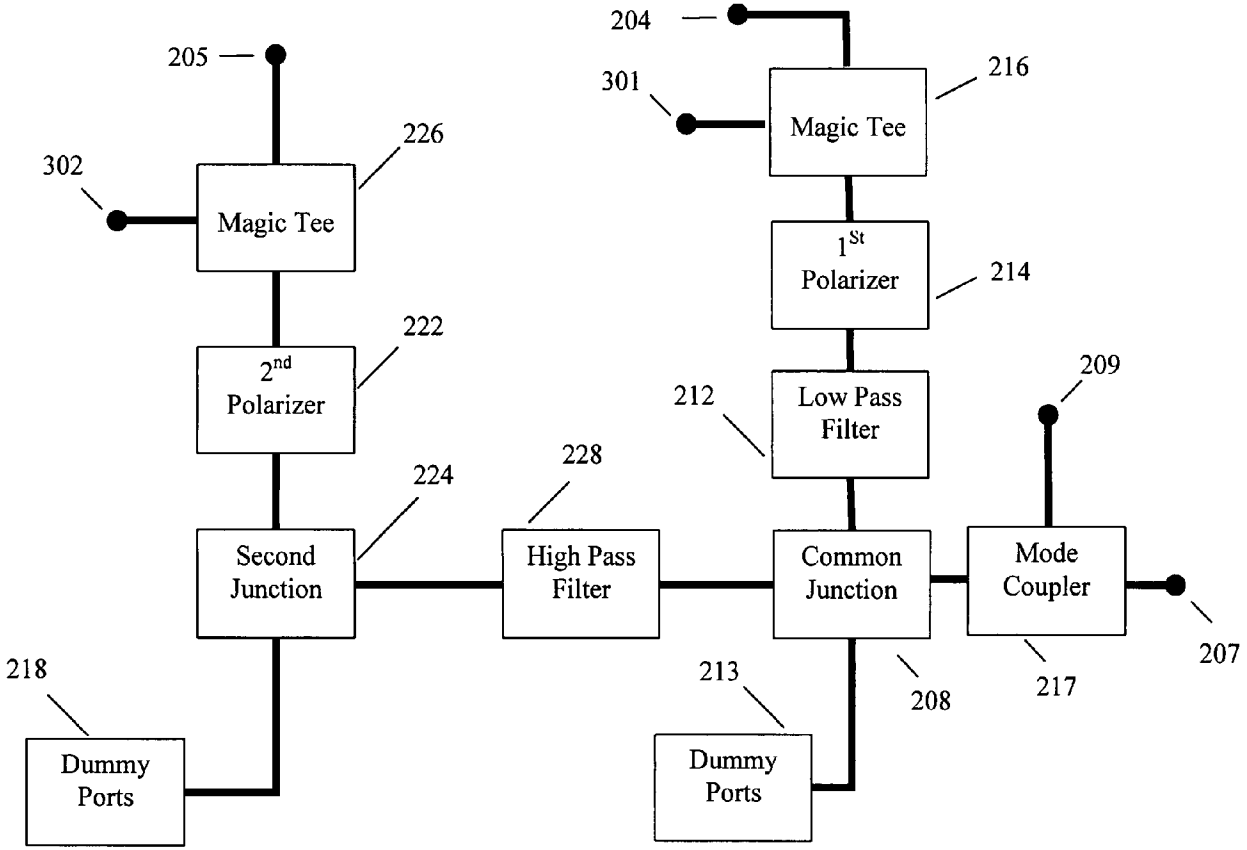
FIG. 4D is a simplified block diagram of the assembly of the multi-frequency waveguide internal structure of FIG. 4C.

An additional embodiment of the present invention, shown in FIG. 4C, is a solid front left side perspective view of the assembly of the multi-frequency waveguide internal structure 210A, with higher order mode coupler 217 added for tracking. FIG. 4D contains a simplified block diagram of the assembly of the multi-frequency waveguide internal structure 210A. Higher order mode coupler 217 with tracking port 209 is placed between horn input/output area 207 and first common junction 208. Thus, the only difference between previously described multi-frequency waveguide internal structure 210 (FIG. 4A) embodiment and the additional embodiment multi-frequency waveguide internal structure 210A (FIG. 4C) is the inclusion of the tracking function via the addition of higher order mode coupler 217. Multi-frequency waveguide internal structure 210A has axial length L3. Fabrication of multi-frequency waveguide internal structure 210A is similar to that of multi-frequency waveguide internal structure 210 but requires an additional split block to accommodate higher order mode coupler 217. This will be shown and described below in FIGS. 10A, 10B, 11A, 11B.

Figure 4E:
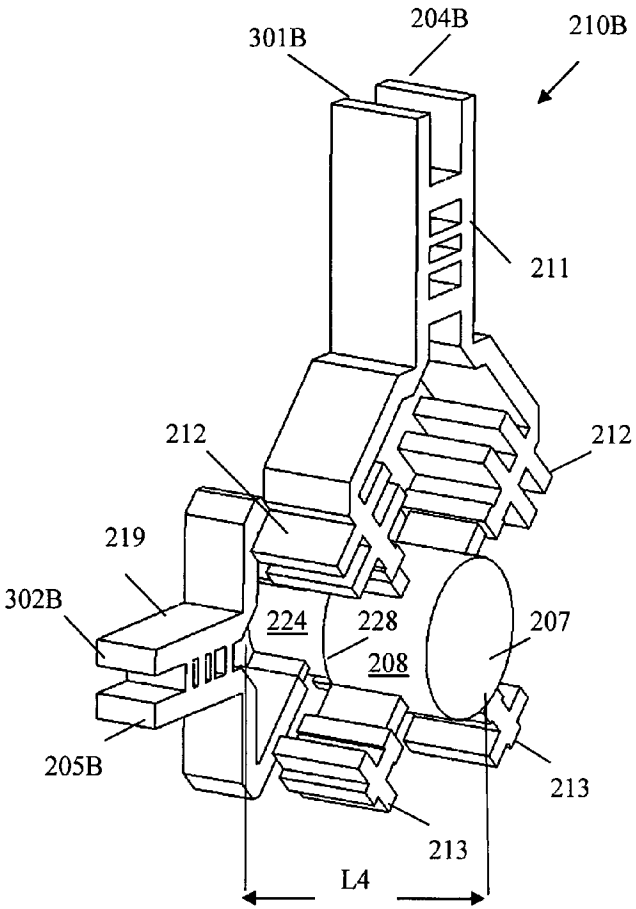
FIG. 4E is a solid front left side perspective view of the assembly of the multi-frequency waveguide internal structure, with a Quadrature Hybrid replacing the 90° polarizers and hybrid tees, an additional embodiment of the present invention.
Figure 4F:
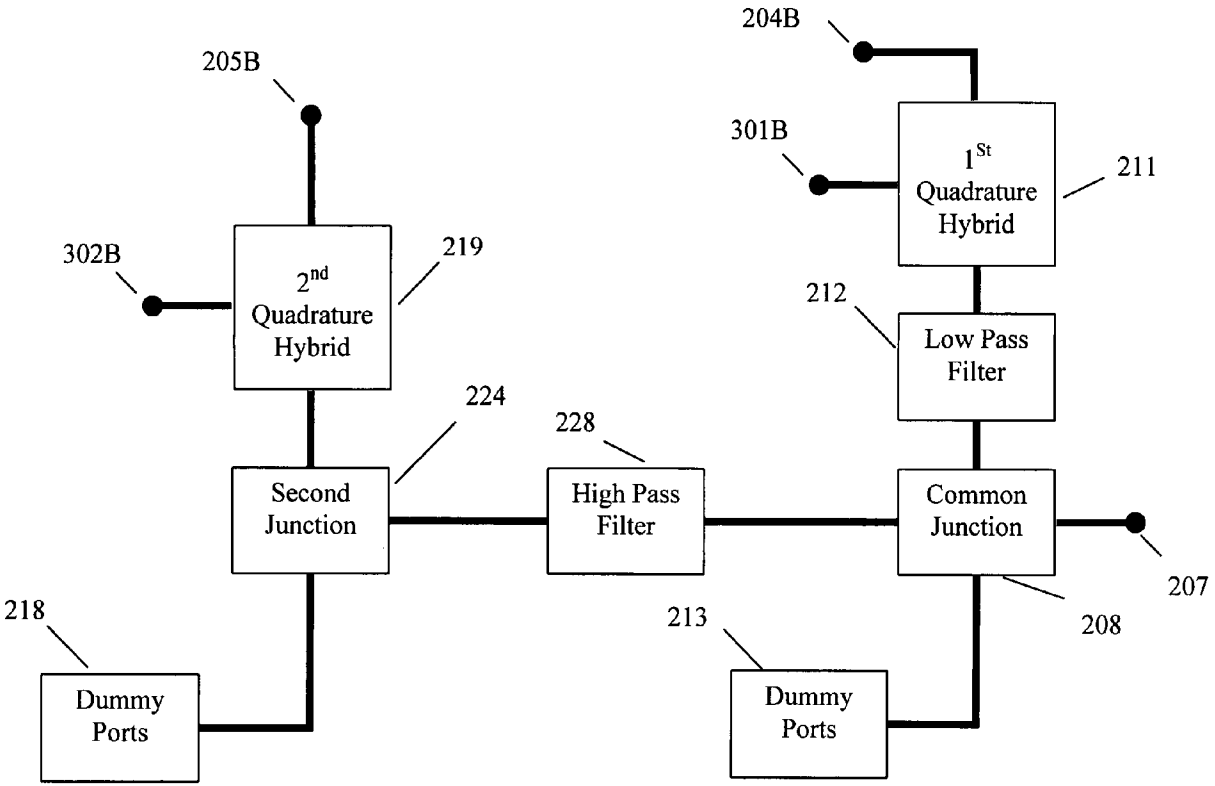
FIG. 4F is a simplified block diagram of the assembly of the multi-frequency waveguide internal structure of FIG. 4E.

An additional embodiment of the present invention, shown in FIG. 4E, is a solid front left side perspective view of the assembly of multi-frequency waveguide internal structure 210B, with waveguide Quadrature Hybrid 211 in place of the polarizer 214 and magic tee (hybrid tee) 216. FIG. 4F contains a simplified block diagram of the assembly of multi-frequency waveguide internal structure 210B. Quadrature Hybrid 211 performs the same electrically as the 90° polarizer and the magic tee (hybrid tee) with the added benefit of being able to adjust the amplitude balance of the input/output. An input signal passes into first common junction 208, and into LF filters 212 as polarized. The lowest frequency signal then moves through LF Quadrature Hybrid 211 where it performs a 90° phase shift and recombines the two orthogonal components for the signal. The signal then goes to receiver electronics through LF RHCP port 301B or LF LHCP port 204B. For linear polarization, Quadrature Hybrid 211 is not needed. In this case, vertical and horizontal polarization ports would be placed directly after each LF filter 212, extended to the sidewall of the split block. Junction 224 moves higher frequency signals to HF filtering section 228, and then to HF Quadrature Hybrid 219. The HF signal then exits out through HF RHCP port 302B or HF LHCP port 205B. For linear polarization, Quadrature Hybrid 219 is not needed. In this case, vertical and horizontal polarization ports would be placed directly after HF junction 224, extended to the sidewall of the split block. Multi-frequency waveguide internal structure 210B has axial length L4.

Figure 4G:
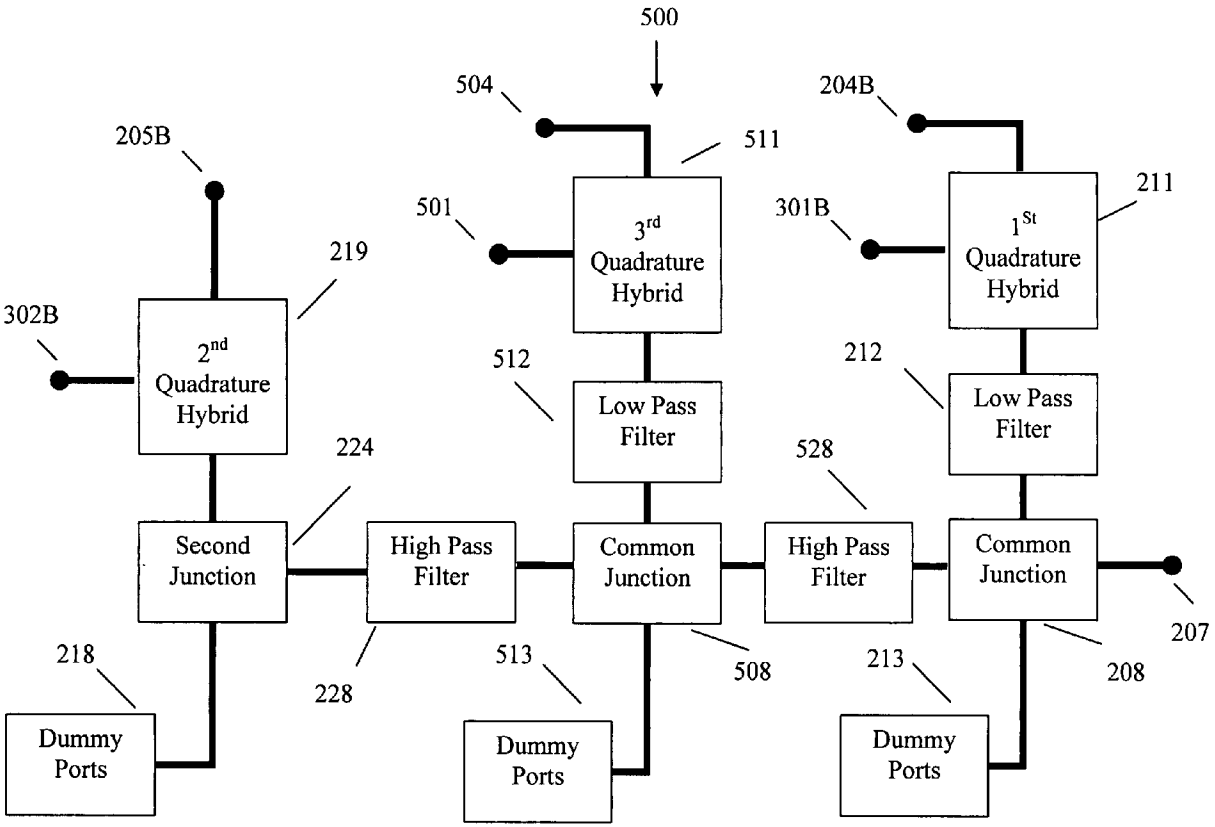
FIG. 4G is a simplified block diagram of an alternative embodiment of the assembly of the multi-frequency waveguide internal structure of FIG. 4E.

In another embodiment, multi-frequency waveguide internal structure 210B could be modified to support additional frequency bands. For each additional frequency band needed, an additional module may be added. Each module may comprise a common junction, a set of dummy ports, a low pass filter, and a Quadrature Hybrid. By way of example and not of limitation, FIG. 4G contains a simplified block diagram of multi-frequency waveguide internal structure 210B modified to support three frequency bands. In order to support a third frequency band, module 500 may be added. Module 500 may comprise common junction 508, dummy ports 513, low pass filter 512, and third Quadrature Hybrid 511. High pass filter 528 may be formed by the junction of common junction 208 and common junction 508. Third frequency band signals may exit through RHCP port 501 and LHCP port 504.

Figure 5B:
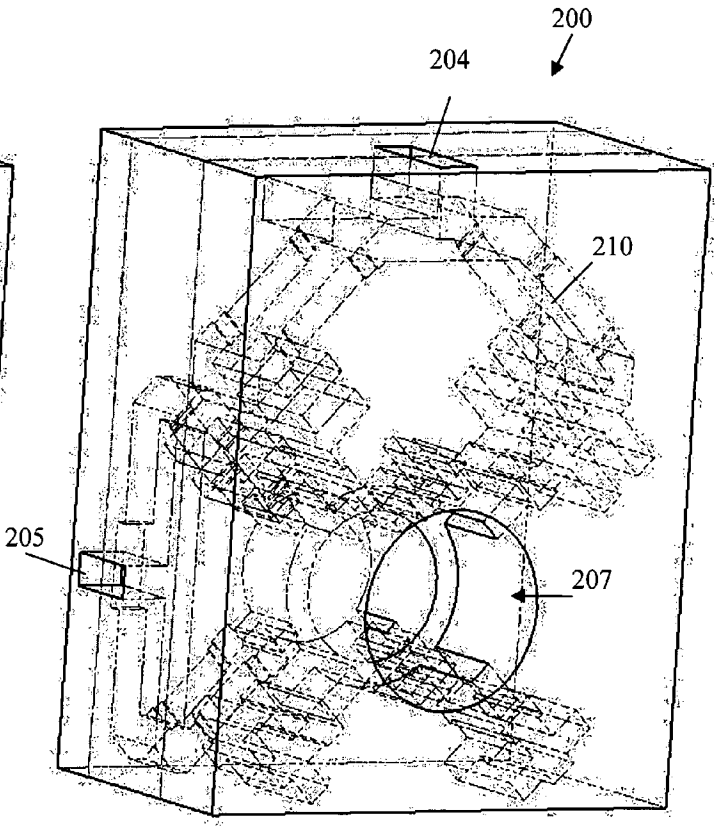
FIG. 5B is a left side frontal perspective view also showing the interior of the antenna feed assembly of an embodiment of the present invention as viewed from the horn side.
Figure 5A:
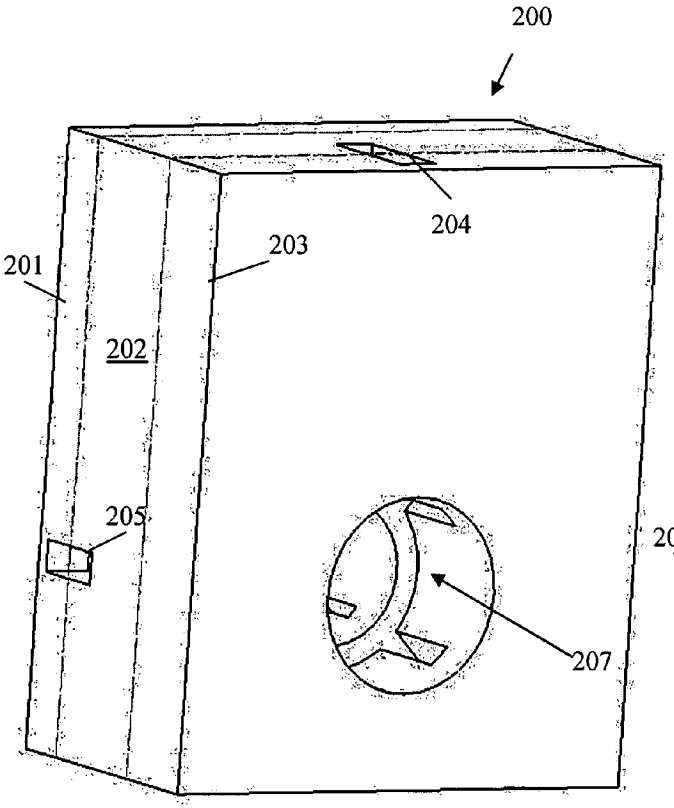
FIG. 5A is a left side frontal perspective view of the exterior portions of the antenna feed assembly of an embodiment of present invention as viewed from the horn side.

FIGS. 5A, 5B show the left side frontal perspective views of the an embodiment of the present invention, which is a split block, three section compact assembly comprising all of the functions as previously described in FIG. 4A above. Compact multi-frequency feed 200 is shown with a layout in a three split block structural configuration. Split block sections include center block 202, which is between frontal block 203 and rear block 201. Shown are horn input/output area 207, LF LHCP port 204 and HF LHCP port 205. FIG. 5B is the identical perspective view as shown in FIG. 5A and additionally shows multi-frequency waveguide internal structure 210 (ref. FIG. 4A), which will be described in more detail below in FIG. 6.

From FIGS. 5A and 5B it can be seen that the blocks are split about the zero current line for each of the waveguide structures in order to prevent degradation in electrical performance. The present invention could also comprise multiple central blocks as necessary to obtain the desired number of frequency bands for the waveguide feed.

Figure 5D:
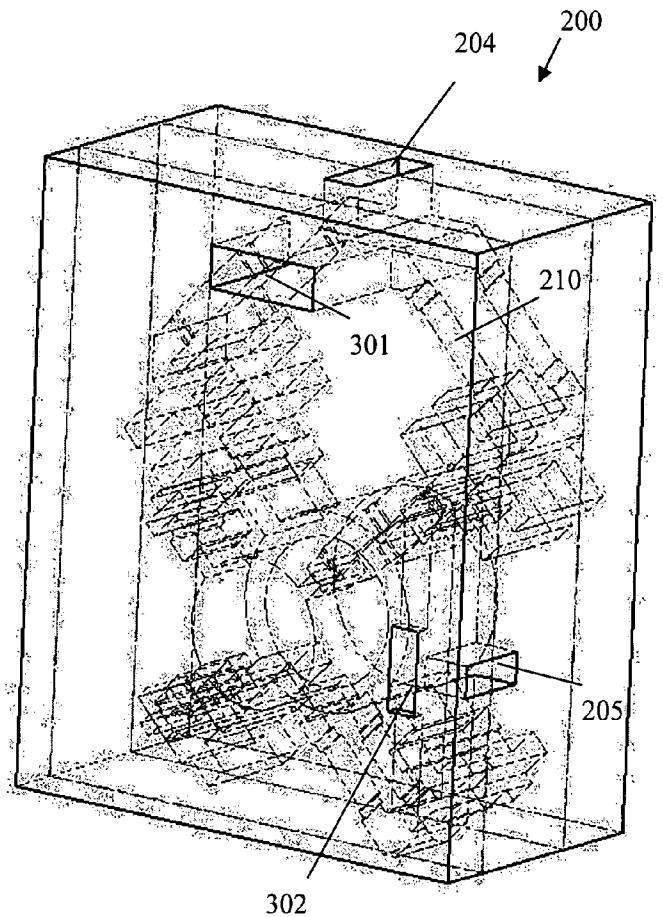
FIG. 5D is a left side rear perspective view also showing the interior of the antenna feed assembly of an embodiment of the present invention viewed from the side opposite the horn.
Figure 5C:
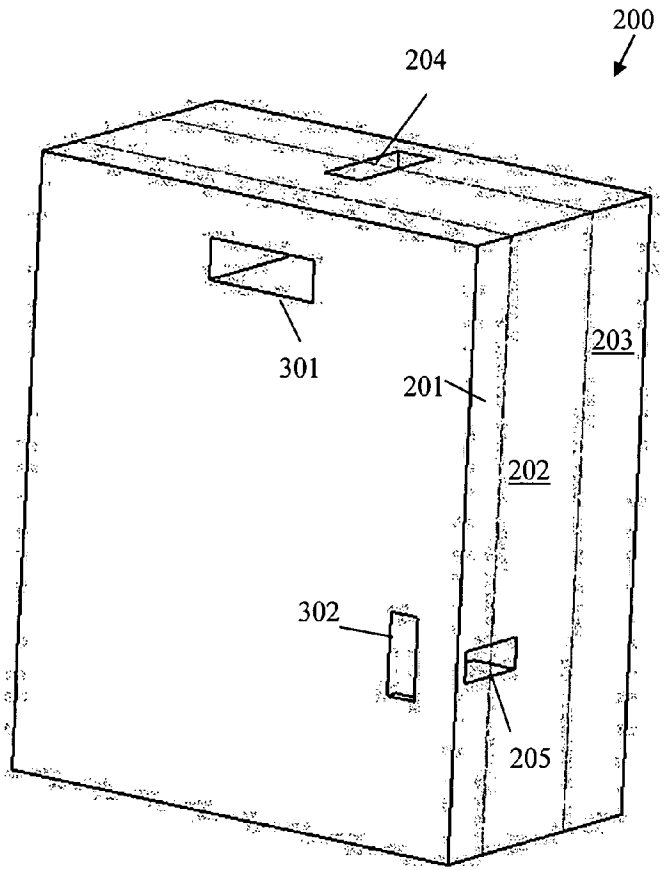
FIG. 5C is a left side rear perspective view of the exterior portions of the antenna feed assembly of an embodiment of present invention as viewed from the side opposite the horn.

FIGS. 5C, 5D, show the left side rear perspective views of an embodiment of the present invention as viewed from the side opposite the horn. In FIG. 5C compact multi-frequency feed 200 is shown with center block 202, frontal block 203, and rear block 201. Shown are HF RHCP port 302, HF LHCP port 205, LF LHCP port 204, and LF RHCP 301. FIG. 5D shows the multi-frequency waveguide internal structure 210 (ref. FIG. 4A), which will be described in more detail below in FIG. 7.

To achieve any combination of single/dual linear/circularly polarized signals there are multiple ports in the antenna feed system. FIGS. 5A, 5B show that there are two ports on the sides (left front and top side respectively) of the blocks that contain the input/output of the antenna feed system. The LHCP input/output for the higher frequency band of the antenna feed system is from HF LHCP port 205. The lower frequency LHCP band input/output for the antenna feed system is from LF LHCP port 204. FIGS. 5C, 5D show that there are two more ports on the rear side section 201 opposite to the horn, or antenna area. All four ports are visible on FIGS. 5C, 5D. Ports on the rear are LF RHCP port 301 and HF RHCP port 302. These both contain input/output of the antenna feed system for the RHCP polarization of the feed system.

Figure 6A:
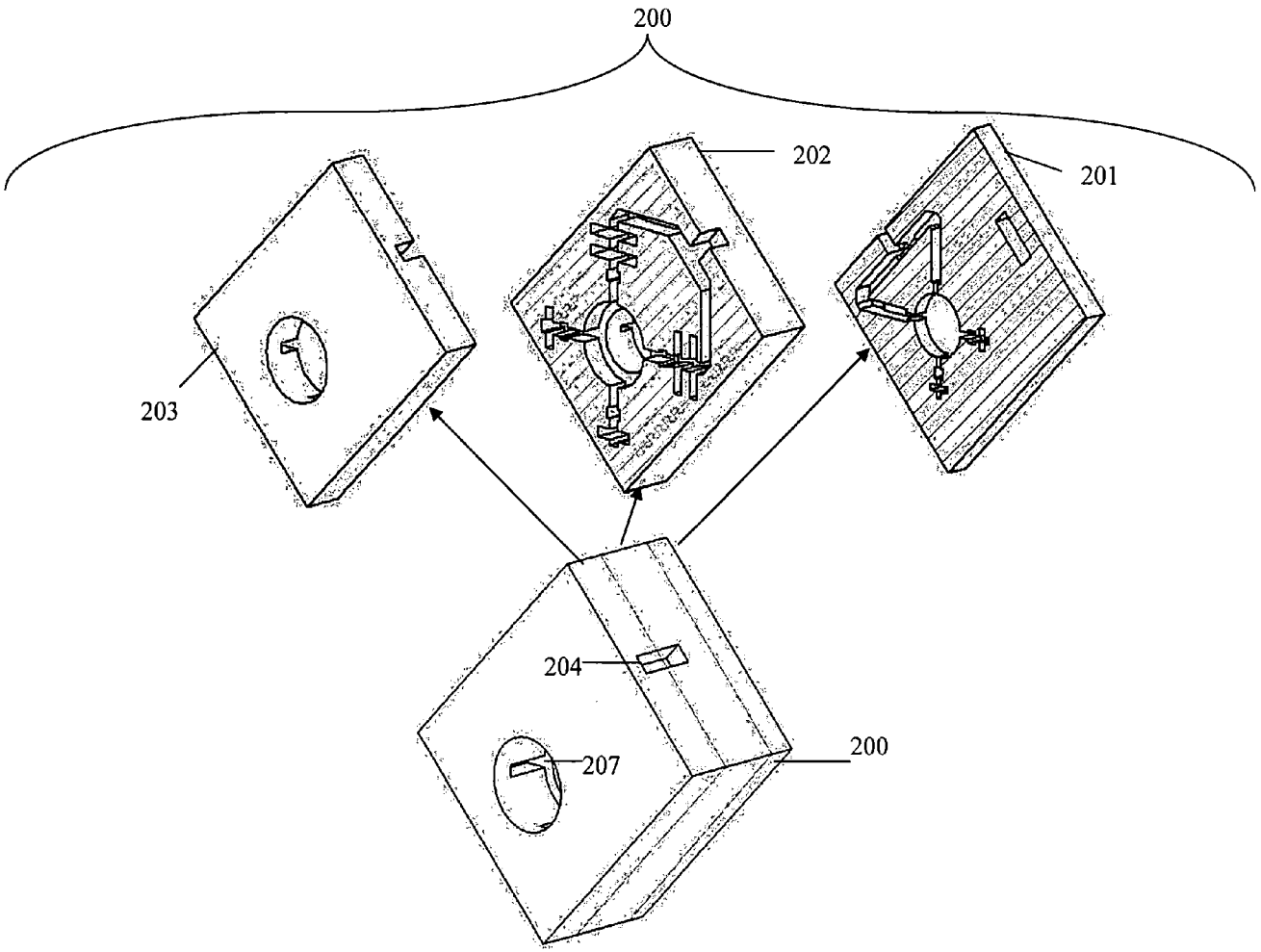
FIG. 6A is an exploded right side frontal perspective view of the compact multi-frequency feed and its three blocks of an embodiment of the present invention.

FIG. 6A is an enlarged right side frontal perspective view of the compact multi-frequency feed 200 and its three blocks; center block 202, frontal block 203, and rear block 201 of an embodiment of the present invention. Also shown is LF LHCP port 204 and horn input junction 207. Inner sections will be described below in FIGS. 7A, 7B, 8A, 8B, 9A, and 9B.

Figure 6B:
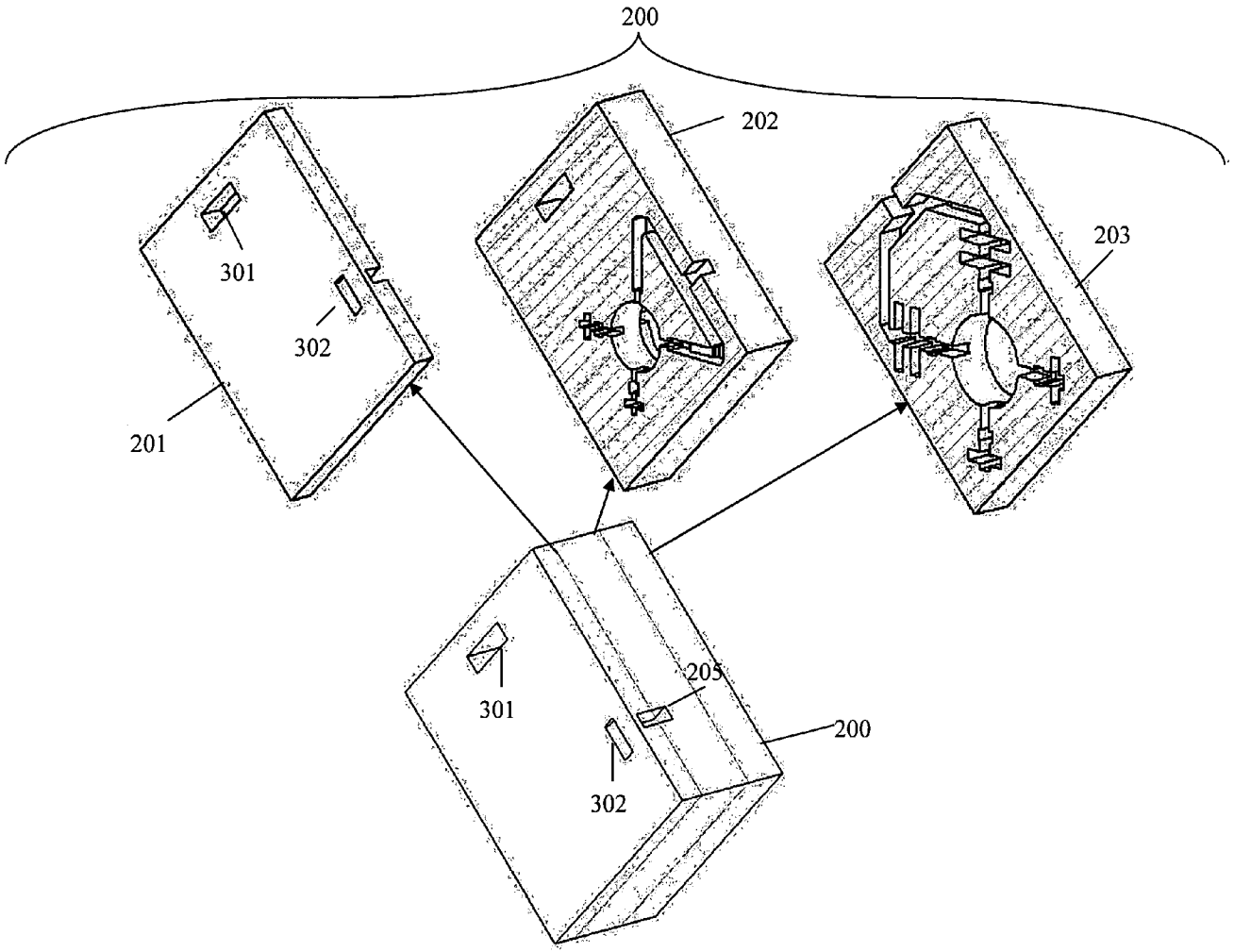
FIG. 6B is an exploded rear left side perspective view of the compact multi-frequency feed and its three blocks of an embodiment of the present invention.

FIG. 6B is an enlarged rear left side perspective view of the compact multi-frequency feed 200 and its three blocks; center block 202, frontal block 203, and rear block 201 of an embodiment of the present invention. Also shown are HF RHCP port 302 and LF RHCP port 301. Inner sections will be described below in FIGS. 7A, 7B, 8A, 8B, 9A, and 9B.

Center block 202 as shown above contains one half of the waveguide structures for each band of the two band antenna feed shown. The other half of each waveguide structure is contained in the opposing block. Outer block 203 will have the connection to horn input junction 207, which can be designed with the properties that are necessary to obtain the desired performance of the system.

Figure 7B:
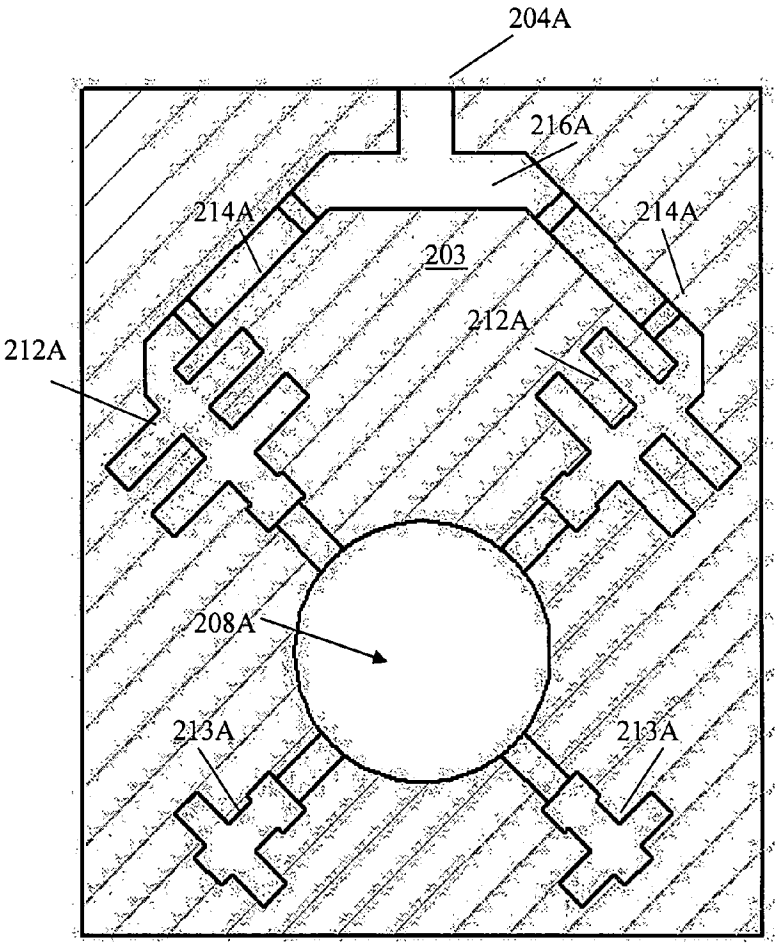
FIG. 7B is a rear side view of frontal block section.
Figure 7A:
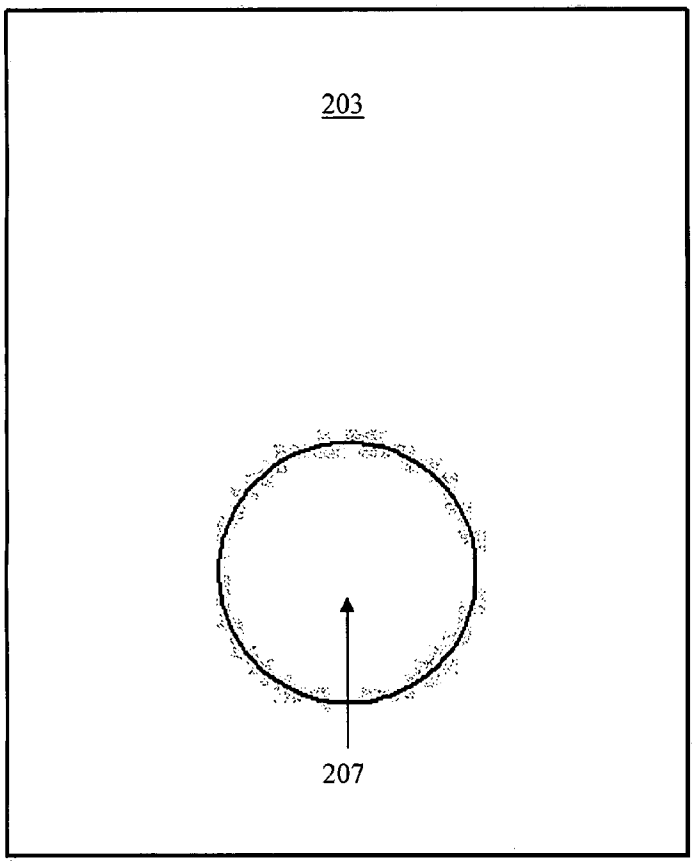
FIG. 7A is a front side view of frontal block section.

FIG. 7A is a front view of frontal block section 203 showing horn input junction 207. Horn input junction 207 will have a connection to an antenna horn. The antenna horn may be an integral part of the structure or an individual part.

FIG. 7B is a rear view of frontal block section 203 with the recesses made into the block of material. All recesses will be described herein with suffixes 'A' or 'B' on previous numbering of FIGS. 4A, 4C, as the recesses form a function, which is completed by joining two or more adjacent block sections. For example, 212A (FIG. 7B) would mate with 212B (FIG. 8A) to form low pass filter 212 (FIG. 4). Horn input junction 207 (FIG. 7A) is continued to previously described first common junction 208A. First common junction 208A branches to connect filters 212A to reject all higher frequency bands. After the filters there is waveguide polarizer 214A. Waveguide polarizer 214A can be any device that creates a 90° phase delay between the two liner signals traveling in the two orthogonal paths. Connected to the waveguide polarizer is a hybrid magic tee (hybrid tee) 216A that combines the signals in such a way that one can obtain both LHCP and RHCP signals. LF LHCP port 204A is shown at the top of frontal block section 203. The LF LHCP signal will be produced at the LF LHCP port 204 and the RHCP signal is produced at LF RHCP port 301, shown below in sections 201 and 202. If the system does not require both LHCP and RHCP, a standard tee can replace hybrid magic tee (hybrid tee) 216. If the signal is linearly polarized the vertical and horizontal polarization ports would be placed directly after each LF filter 212, extended to the sidewall of the split block. Also attached to the first common junction 208A are dummy ports 213A, which are used when a symmetrical structure is required to eliminate unwanted modes and to help axial ratio. Axial ratio is related to an electromagnetic wave having elliptical polarization, the ratio of the magnitudes of the major axis and the minor axis of the ellipse described by the electric field vector.

Frontal block 203 and center block 202, when combined, contain all structures of, and form in their recesses a complete waveguide structure for the lowest frequency band of compact multi-frequency feed 200. Center block 202 (FIGS. 8A, 8B) contains a portion (junction 224A) of HF junction 224 connecting to the higher frequency band of compact multi-frequency feed 200. It also includes HF filtering section 228 that will allow only higher frequency signals to propagate to the higher frequency junction 224.

Figure 8B:
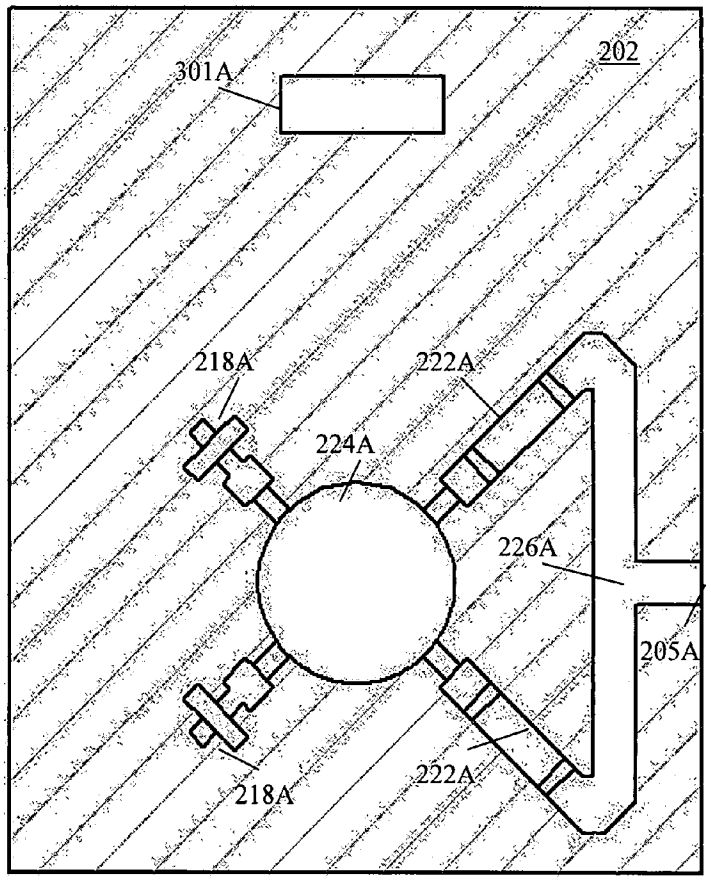
FIG. 8B shows the rear side view of the center block of the compact multi-frequency feed.
Figure 8A:
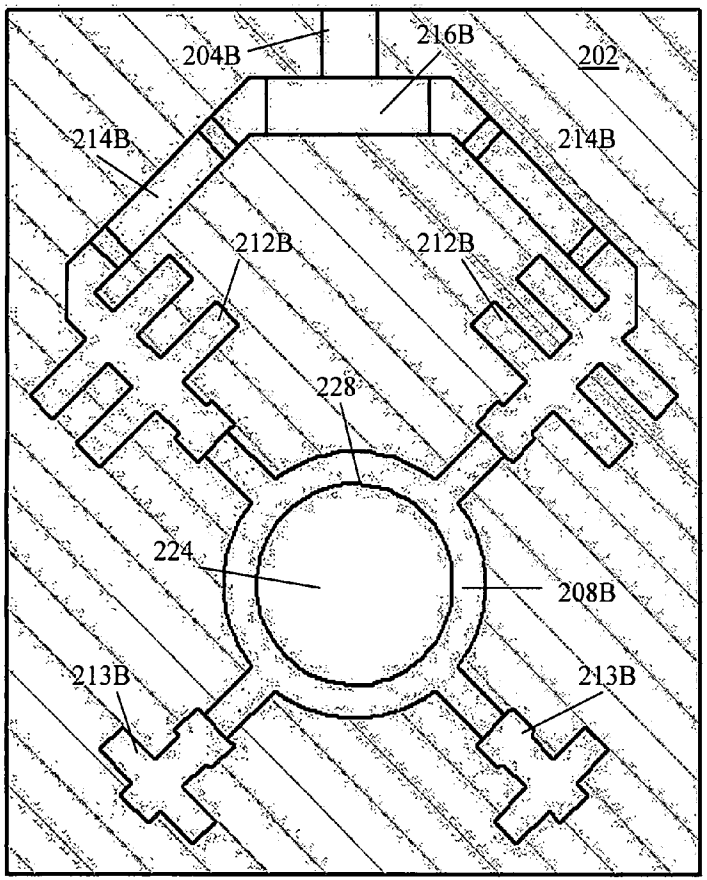
FIG. 8A shows the front side view of the center block of the compact multi-frequency feed.

FIGS. 8A, 8B show the front and the rear views of the center block 202 of the compact multi-frequency feed 200. The front face of center block 202 (FIG. 8A) will be attached to the rear face of frontal block 203 (FIG. 7B) and the rear face of center block 202 will be attached to the front face of rear block 201 (FIG. 9A).

FIG. 8A shows HF filtering section 228 that allows only higher frequency signals to propagate to HF junction 224. Shown are LF LHCP port 204B, LF magic tee (hybrid tee) 216B, LF polarizers 214B, first common junction 208B, LF low pass filters 212B, and dummy ports 213B.

FIG. 8B is a detailed view of the rear of center block 202 with the internal recesses made into the material. HF junction 224A is connected to waveguide polarizer 222A. Waveguide polarizer 222A can be any device that creates a 90° phase delay between the two liner signals traveling in the two orthogonal paths. If the signal is linearly polarized the vertical and horizontal polarization ports would be placed directly after the HF junction 224A, and then extended to the sidewall of the split block. In this layer like the last, dummy port sections 218A are required when a symmetrical structure is required to eliminate unwanted modes and to help axial ratio. The RHCP signal from the lower frequency band travels through LF RHCP port 301A to its final destination in LF RHCP port 301. Shown is HF LHCP port 205A and hybrid tee 226A.

Other center block sections similar to or containing various configurations can be repeated for as many unique frequency bands as are desired by the application for which they are intend for use.

Figure 9B:
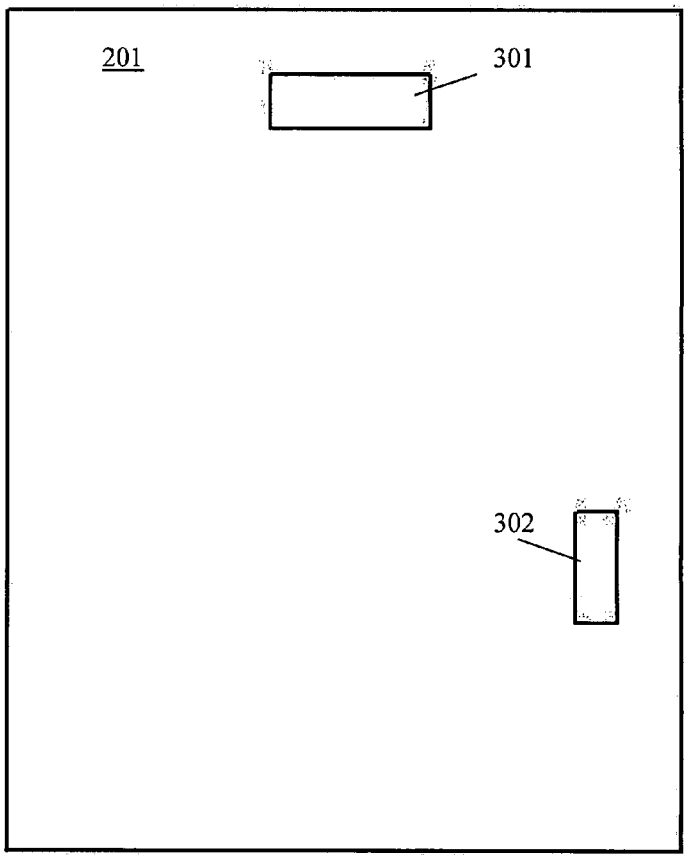
FIG. 9B shows the rear side view of the rear block of the compact multi-frequency feed.
Figure 9A:
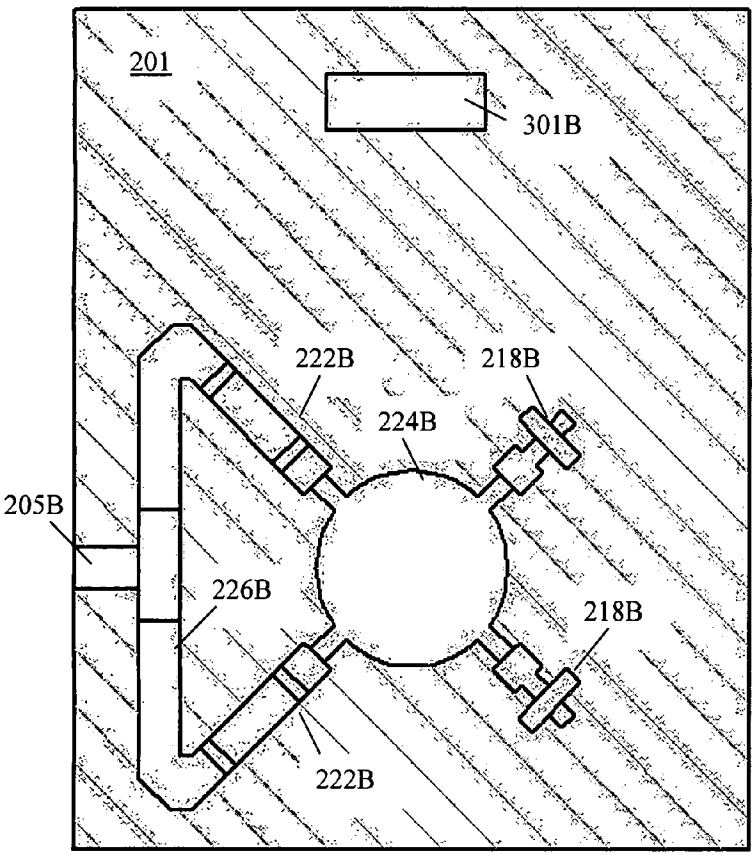
FIG. 9A shows the front side view of the rear block of the compact multi-frequency feed.

FIGS. 9A, 9B show both front and rear views of rear block 201 section of compact multi-frequency feed 200.

Since the FIG. 9A is the second half of all the structures that are defined in FIG. 8B, when the two block sections 201, 202 are placed together they form in their recesses a complete wave guide structure for the highest frequency band of compact multi-frequency feed 200. Rear block 201 also contains the input/output for the LF RHCP port 301.

FIG. 9A is a detailed view of the front of rear block 201 with the internal recesses made into material. HF junction 224B, is connected to waveguide polarizer 222B. Waveguide polarizer 222B which is then connected to hybrid tee 226B which, when combined with 226A, will allow circular polarized signals to propagate to the input/output ports. If the signal is linearly polarized the vertical and horizontal polarization ports would be placed directly after HF junction 224B, extended to the sidewall of the split block. In this layer like the last dummy port sections 218B are required when a symmetrical structure is required to eliminate unwanted modes and to help axial ratio. The RHCP signal from the lower frequency band travels through LF RHCP port 301B to its final destination in LF RHCP port 301. Also shown is HF LHCP port 205B.

FIG. 9B shows the output ports for both of the RHCP signals for both bands, LF RHCP port 301 and HF RHCP 302, of compact multi-frequency feed 200. The HF RHCP port 302 is perpendicular to the LF RHCP port 301. These ports can also be seen from FIGS. 5C, 5D.

It should be noted that although an embodiment of the present invention has been described above with four ports and two frequency bands, it also applies to addition of any required number of frequency bands with additional designed center sections.

Figure 10A:
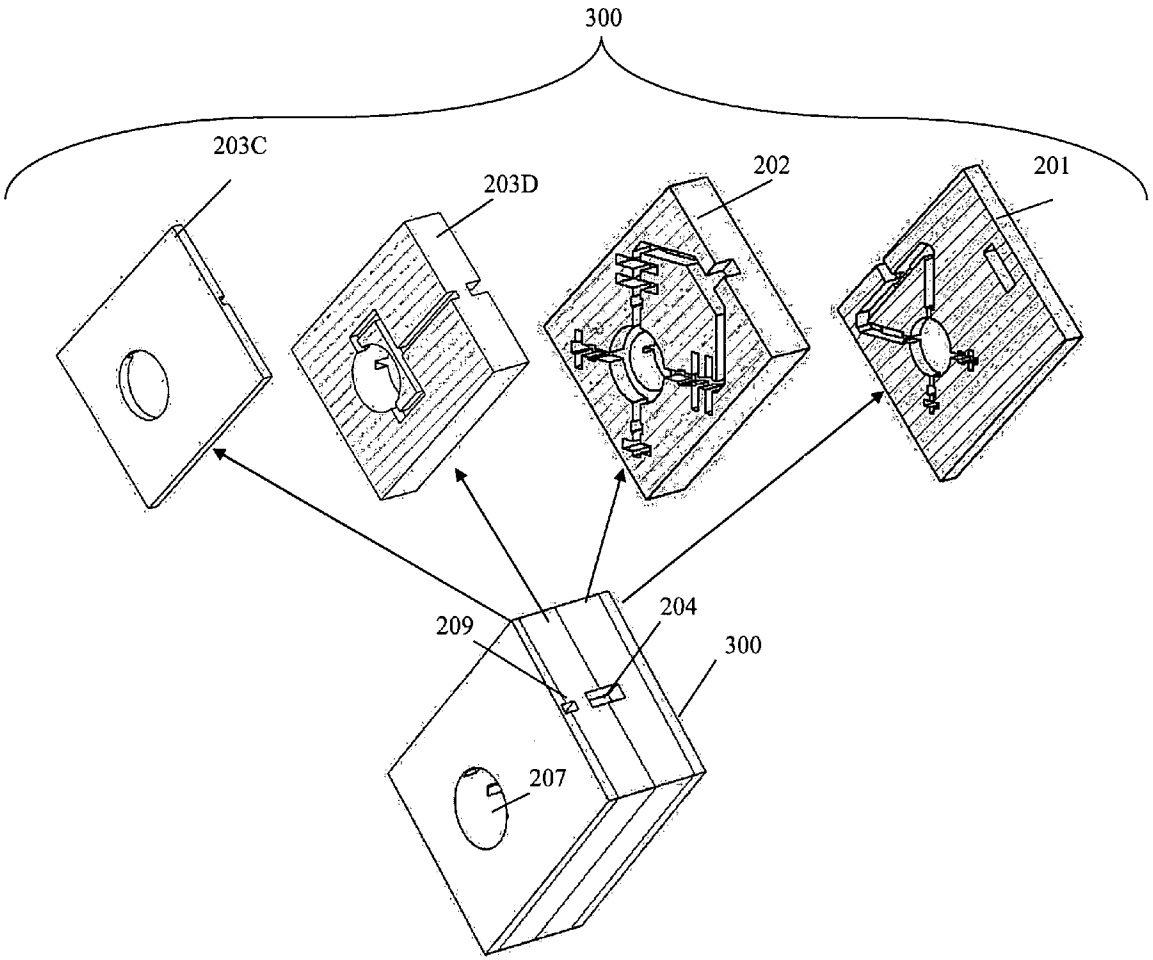
FIG. 10A is an exploded right side frontal perspective view of the compact multi-frequency feed and its four blocks of an additional embodiment of the present invention with tracking.
Figure 10B:
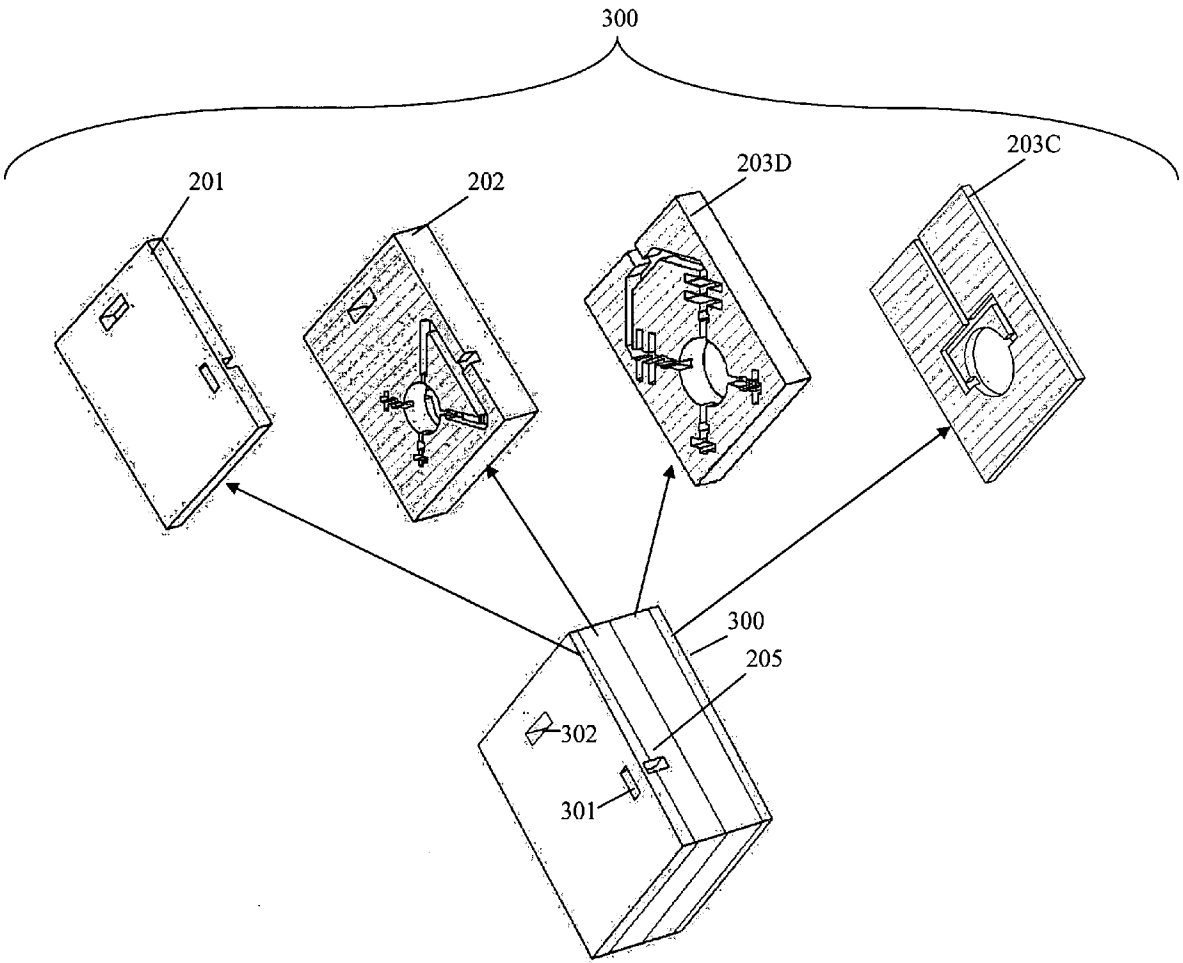
FIG. 10B is an exploded rear left side perspective view of the compact multi-frequency feed and its four blocks of an additional embodiment of the present invention with tracking.

FIGS. 10A, 10B show the additional embodiment multi-frequency waveguide with tracking 300 that has internal structure 210A shown in FIG. 4C. This structure accommodates the inclusion of the tracking function via the addition of higher order mode coupler 217 (ref. FIG. 4C). Split block sections 203C, 203D accommodate tracking and will be described below in FIGS. 11A, 11B, 12A, 12B. Rear center block 202 and rear block 201 split block sections are identical to those previously described in FIGS. 8A, 8B, 9A, 9B and thus will not be described below.

FIG. 10A is an enlarged right side frontal perspective view of the compact multi-frequency feed with tracking 300 and its four split blocks of an additional embodiment of the present invention. Shown are compact multi-frequency feed with tracking 300 and its four split blocks; frontal block 203C, frontal center block 203D, rear center block 202, and rear block 201. Also shown is LF LHCP port 204, tracking port 209, and horn input junction 207.

FIG. 10B is an enlarged rear left side perspective view of the compact multi-frequency feed with tracking 300 and its four blocks of the additional embodiment of the present invention. FIG. 10B shows four split blocks; rear block 201, rear center block 202 and front center block 203D, and frontal block 203C, for the additional embodiment of the present invention. Also shown are HF RHCP port 302 LF RHCP port 301, and HF LHCP port 205. Inner sections will be described below in FIGS. 11A, 11B, 12A, and 12B.

Figure 11B:
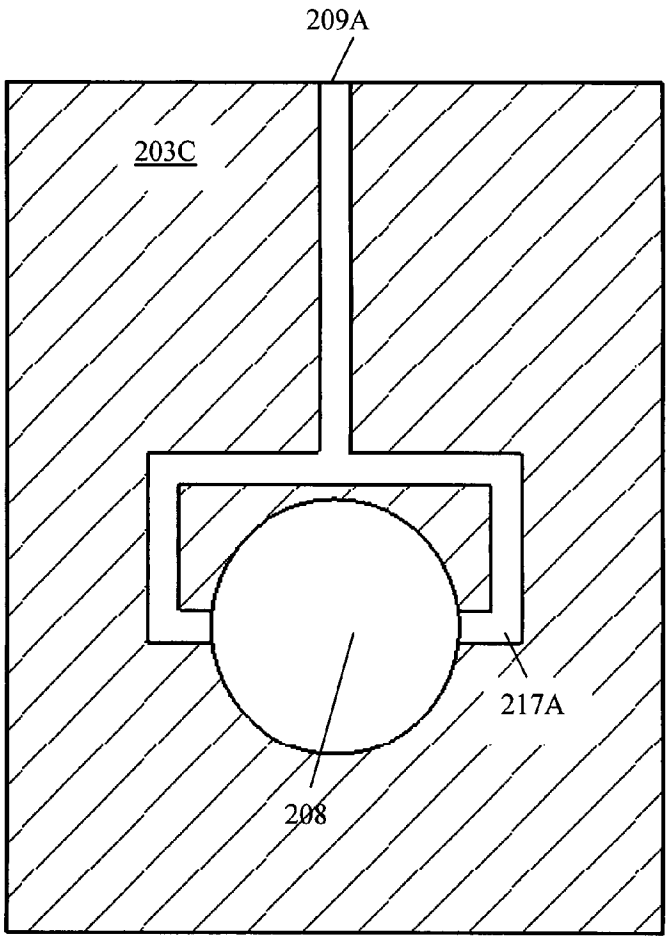
FIG. 11B is a rear side view of the frontal block of an additional embodiment of the present invention with tracking.
Figure 11A:
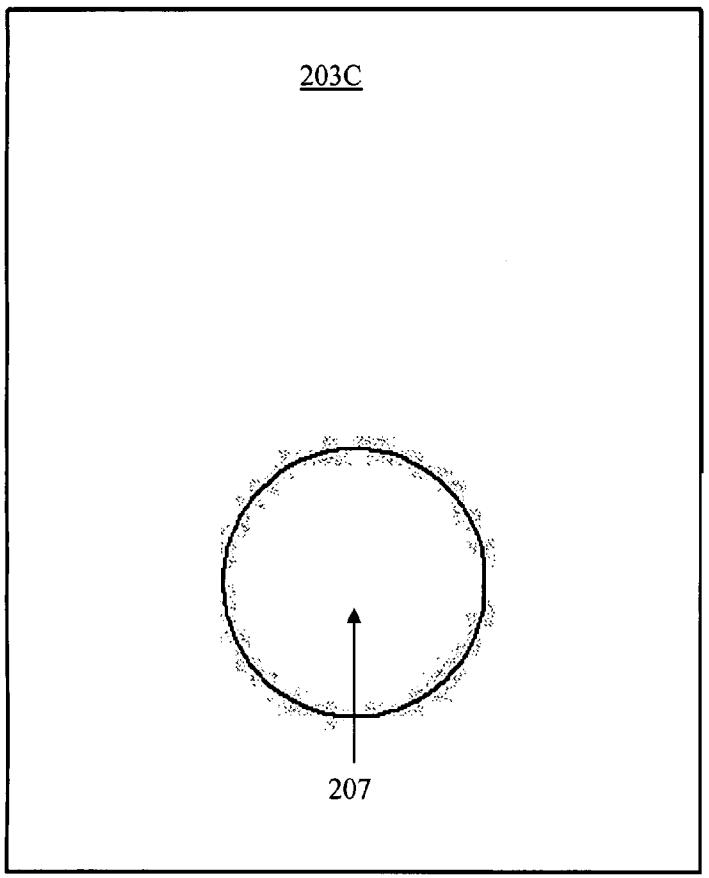
FIG. 11A is a front side view of the frontal block of an additional embodiment of the present invention with tracking.

FIG. 11A is a front side view of the frontal block section 203C of an additional embodiment of the present invention with tracking showing horn input junction 207. Horn input junction 207 will have a connection to an antenna horn. The antenna horn may be an integral part of the structure or an individual part.

FIG. 11B is a rear side view of the frontal block section 203C showing higher order mode coupler 217A added for tracking. Higher order mode coupler 217A with tracking port 209A is placed between horn input/output area 207 and first common junction 208 (see FIGS. 4A, 4C).

Figure 12B:
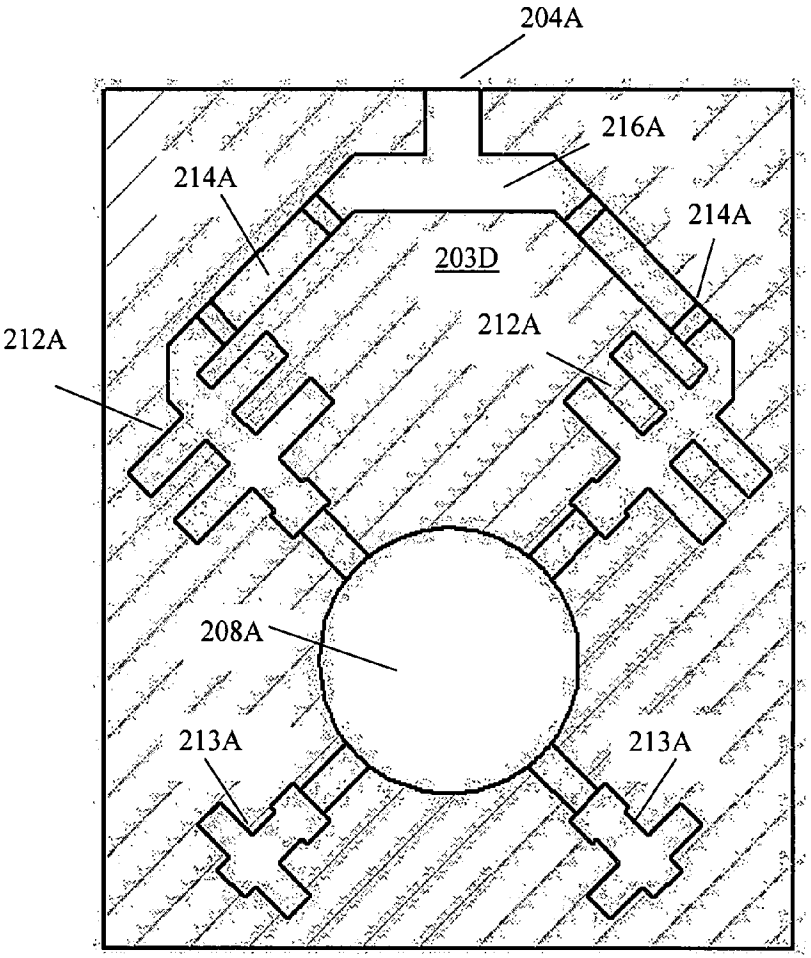
FIG. 12B is a rear side view of the frontal center block of an additional embodiment of the present invention with tracking.
Figure 12A:
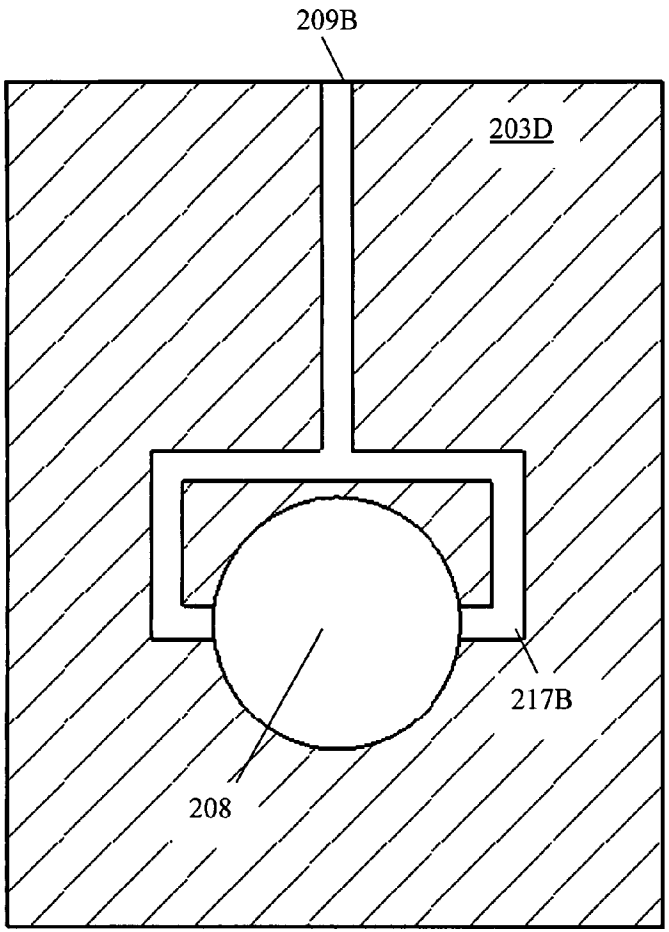
FIG. 12A is a front side view of the frontal center block of an additional embodiment of the present invention with tracking.

FIG. 12A is a front side view of the frontal center block 203D of an additional embodiment of the present invention with tracking. Shown in FIG. 12A, off of first common junction 208, is higher order mode coupler 217B and tracking port 209B. FIG. 12B the rear side view of frontal center block 203D and is identical to FIG. 7B as previously described.

Frontal block 203C and frontal center block 203D, when combined, contain all structures of higher order mode coupler 217 and tracking port 209 to accommodate the addition of tracking in an additional embodiment of the present invention.

Figure 13:
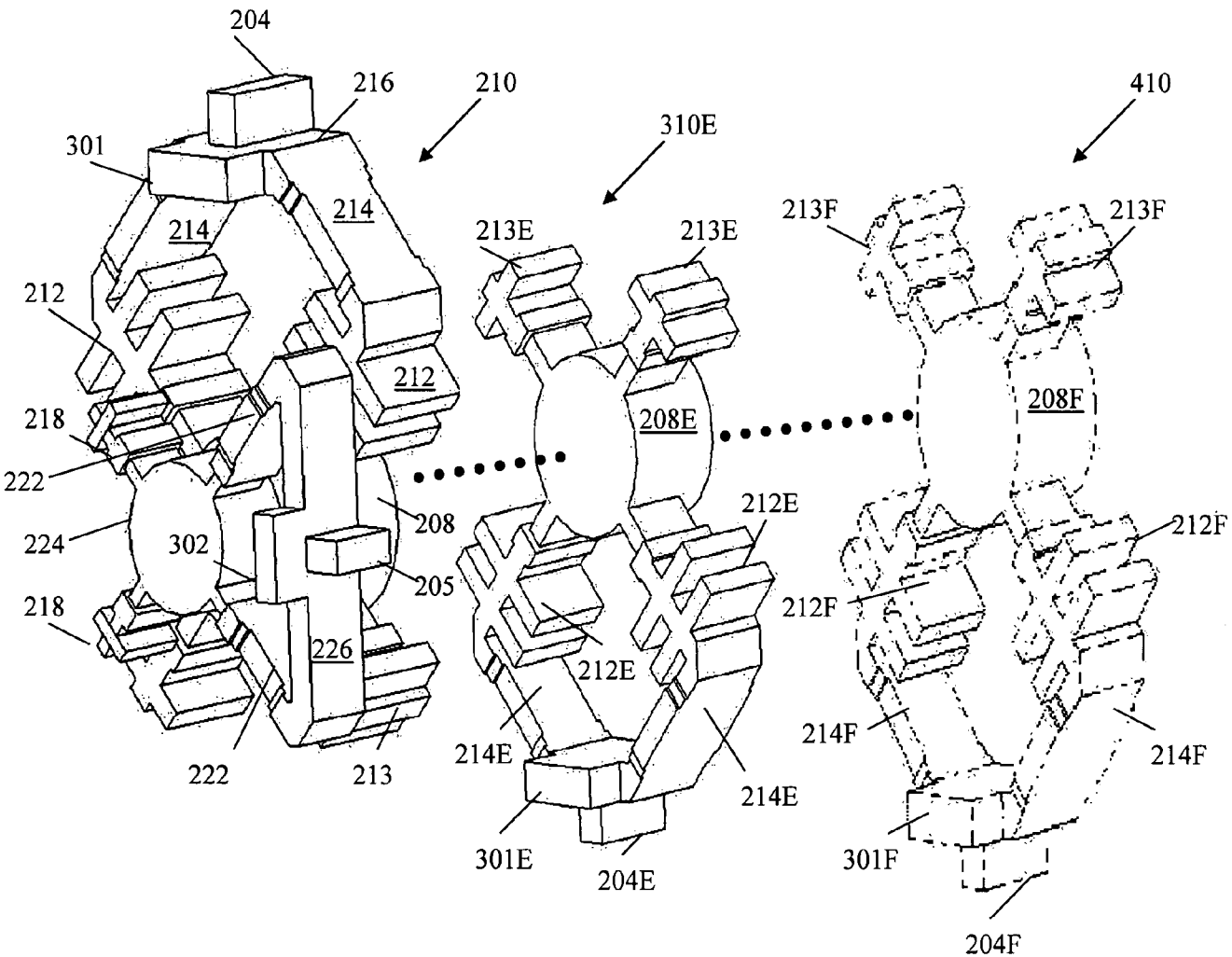
FIG. 13 is a solid rear left side perspective view of the assembly of the multi-frequency waveguide internal structure having a third modular area for an additional frequency and extended for other additional frequencies.
Figure 14:
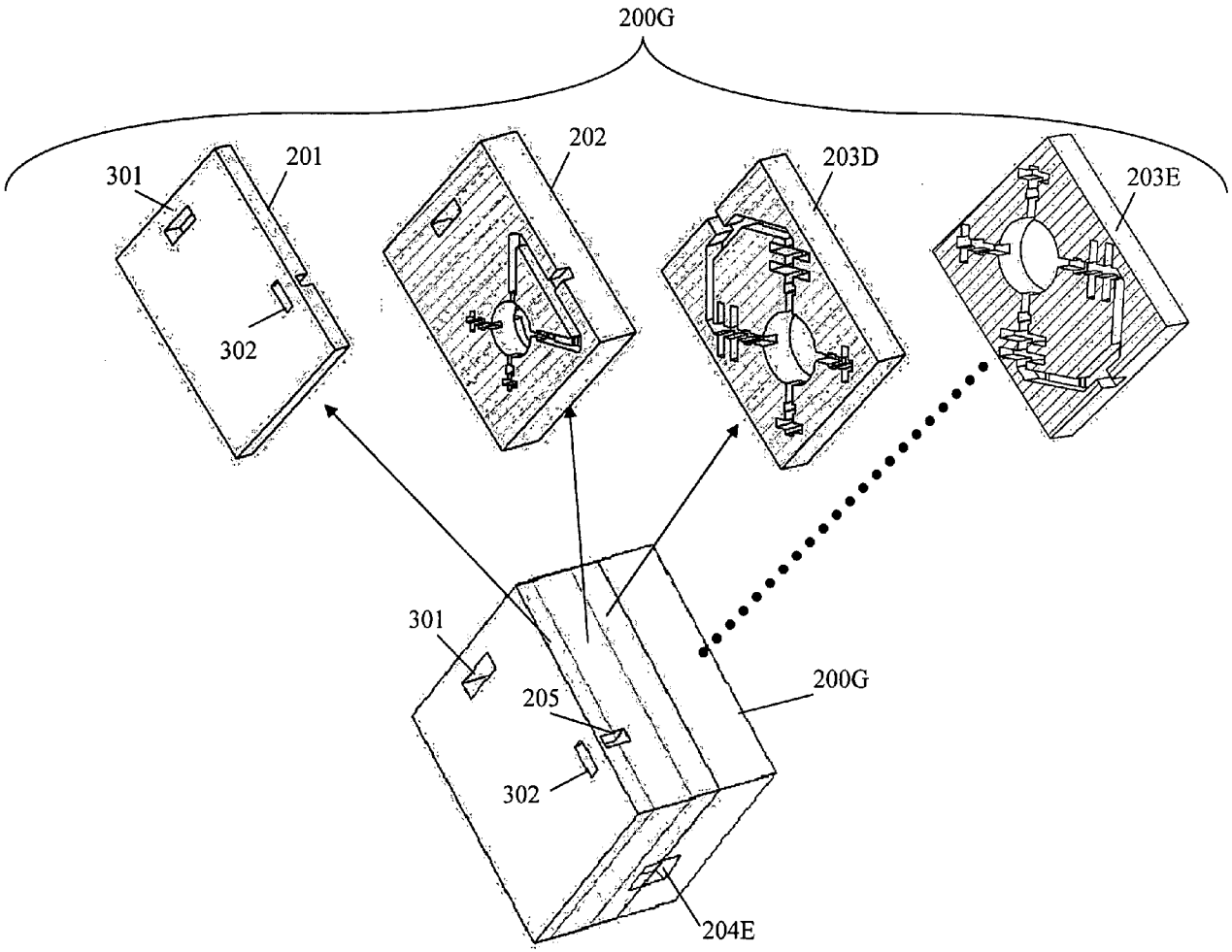
FIG. 14 is an exploded right side frontal perspective view of the compact multi-frequency feed having a third modular section for an additional frequency and extended for other additional frequencies.

FIGS. 13, 14 below represent yet additional embodiments of the present invention to accommodate additional frequencies.

FIG. 13 is a solid rear left side perspective view of an additional embodiment of the present invention showing the assembly of the multi-frequency waveguide internal structure showing previously described module 210 and having additional third modular area 310E for an added frequency and can be further extended for additional frequency module areas, 410 i.e. Each module added would have a common junction 208E, dummy ports 213E connected to the junction, filters 212E, polarizers 214E and ports 301E, 204E. Additional frequencies can be added in frequency order by the addition of module areas similar to modular area 310. Module area 410 is shown with similar components as module area 310E using 'F' suffixes for each like element.

FIG. 14 is an exploded right side frontal perspective view of the compact multi-frequency feed 200G having additional modular section block 203E to accommodate a third frequency. For each additional frequency added, another block section is needed. For example, aforementioned modular area 310 (for one additional frequency) would be accommodated in one side of block 203D (not shown) and the visible side of block 203E. All components and layouts are easily concluded from the aforementioned discussions. Additional modular sections are easily added to accommodate additional added frequencies by adding sectional blocks.

The present invention in various embodiments provides an efficient layout of waveguide components, compared to prior art, for multi-frequency band antenna feeds. It allows for compaction of components, maintains good electrical performance, is mechanically robust, eliminates flange connections between components, and is very cost effective to produce in small or large quantities. It can be applied to waveguide components with circular, rectangular, square, elliptical, coaxial, or any cross sections that can be created by making recesses in the split block.

The present invention allows waveguide components that can be machined in a split block configuration. Recesses are created in two pieces of material to produce the waveguide components. The components are formed after assembly of each respective split block. It eliminates the need for flanges between different components. Assembly of the blocks can be done by any method that can effectively hold the blocks together such as bolts, brazing, soldering, and adhesive bonding. Various layouts can be realized using any number of fabrication methods, such as brazing, electroforming, and machining. The apparatus and method of the present invention would reduce size by a factor of about two or more, especially in the dimension of axial length. For example, a multi-frequency waveguide in the range of the Ka-band (18-31 GHz), would typically be about 4" depth×4.5" width by 8" long in prior art, whereas it has been demonstrated that the present invention, in the same frequency range, would reduce the size to about 2" by about 2.5" by about 3" length. Typical split block sections are in a range of about 2" by 2.5" with a depth of about 0.4" to about 1.2". The significant reduction in axial length is a major advantage of the present invention, especially in packaging waveguides in small compartments aboard satellites, aircraft etc. This process is very cost effective and significantly reduces the size of multi-frequency band antenna feeds. The present invention can be applied to waveguide components with circular, rectangular, square, elliptical, co-axial, or any cross sections that can be created by making recesses in the split block. Split block fabrication techniques allow very cost effective manufacturing both during fabrication and assembly regardless of quantities involved.

Split block manufacturing and assembly is used to create the unique structures used in multi-frequency band antenna feeds. For a dual frequency band feed only three blocks are required. A tri-band feed requires an assembly of four blocks. This technique can be used for as many unique frequency bands as are desired by the application for which they are intended for use.

Elimination of the need for flanges between the different components required by the feed eliminates the risk of electrical performance degradation due to flange misalignments and imperfections.

Created blocks are joined at the zero current line of the components, which practically eliminates electrical performance degradation that may arise due to misalignment between two adjacent blocks. There is no limit to the frequency bands that can be applied to it as long as a practical method of fabrication is available. The layout provides the ability to use standard tracking systems.

Although the present invention has been described with reference to preferred embodiments, numerous modifications and variations can be made and still the result will come within the scope of the invention. No limitation with respect to the specific embodiments disclosed herein is intended or should be inferred.

PARTIAL GLOSSARY

| ITEM NAME | ITEM NUMBER |
|---|---|
| Waveguide Asm | 20 |
| Multi-frequency horn | 22 |
| First Common Junction | 24 |
| Low pass filter | 26 |
| First 90 degree polarizer | 28 |
| First waveguide port RHCP | 32 |
| First waveguide port LHCP | 34 |
| First High pass filter | 36 |
| Second common junction | 38 |
| Second low pass filter | 42 |

-continued

PARTIAL GLOSSARY

| ITEM NAME | ITEM NUMBER |
|---|---|
| Second 90-deg polarizer | 44 |
| Second waveguide port RHCP | 46 |
| Second waveguide port LHCP | 48 |
| Second High pass filter | 52 |
| OMT/Polarizer | 54 |
| High frequency RHCP port | 56 |
| High frequency LHCP port | 58 |
| Prior art waveguide asm. | 60 |
| Horn flange | 63 |
| first common junction | 64 |
| First low pass filter | 65 |
| High pass filter | 66 |
| Magic (hybrid) Tee | 67 |
| High pass filter | 68 |
| First 90 deg polarizer | 72 |
| second 90 deg polarizer | 74 |
| high freq RHCP port | 76 |
| low freq RHCP port | 78 |
| Low freq LHCP port | 82 |
| High freq LHCP port | 84 |
| Horn input/output area | 86 |
| Horn taper area | 88 |
| Compact multi-freq feed | 200 |
| rear block | 201 |
| center block | 202 |
| frontal block | 203 |
| low frequency LHCP | 204 |
| high frequency LHCP | 205 |
| multifreq waveguide internal structure | 210 |
| horn input junction | 207 |
| first common junction | 208 |
| LF filter | 212 |
| dummy ports | 213 |
| LF Magic (hybrid) Tee | 216 |
| Higher order mode coupler | 217 |
| LF 90 deg polarizer | 214 |
| Dummy ports | 218 |
| HF 90 deg polarizer | 222 |
| High freq junction | 224 |
| HF magic (hybrid) Tee | 226 |
| HF filtering section | 228 |
| Low freq RHCP port | 301 |
| High freq RHCP port | 302 |
| Module | 500 |
| Common junction | 508 |
| Dummy ports | 513 |
| Low pass filter | 512 |
| High pass filter | 528 |
| 3rd Quadrature Hybrid | 511 |
| RHCP port | 501 |
| LHCP port | 504 |

We claim:

1. A multilayered assembly forming a microwave feed network, the assembly comprising:

a first common junction means functioning to send/receive microwave signals;

the first common junction means connected to a second junction and to a low frequency modular area;

wherein the low frequency modular area comprises a low pass filter and low frequency ports;

wherein an interface between the first common junction means and the second junction functions as a high pass filter;

the second junction connected to the first common junction means and to a high frequency modular area;

wherein the high frequency modular area comprises high frequency ports;

wherein all components of the first common junction means, the second junction, the low frequency modular area, and the high frequency modular area are built in a modular split block configuration; and wherein the modular split block configuration comprises a plurality of split blocks.

2. The assembly of claim 1, wherein all components of the first common junction means, the second junction, the low frequency modular area, and the high frequency modular area are split along respective zero current lines when the split blocks are separated.

3. A multilayered assembly forming a microwave feed network, the assembly comprising:

a first common junction means functioning to provide an input/output area;

the first common junction means connected to a second junction, a first set of dummy ports, and to a low frequency modular area;

wherein the low frequency modular area comprises a low pass filter, a low frequency polarizer, a low frequency hybrid tee, and low frequency ports;

wherein an interface between the first common junction means and the second junction functions as a high pass filter;

the second junction connected to the first common junction means, to a high frequency modular area, and to a second set of dummy ports;

wherein the high frequency modular area comprises a high frequency polarizer, a high frequency hybrid tee, and high frequency ports;

wherein all components of the first common junction means, the second junction, the first set of dummy ports, the second set of dummy ports, the low frequency modular area, and the high frequency modular area are built in a modular split block configuration; and wherein the modular split block configuration comprises a plurality of split blocks.

4. The assembly of claim 3, wherein all components of the first common junction means, the second junction, the first set of dummy ports, the second set of dummy ports, the low frequency modular area, and the high frequency modular area are split along respective zero current lines when the split blocks are separated.

5. A multilayered assembly forming a microwave feed network, the assembly comprising:

a first common junction means functioning to send/receive microwave signals;

the first common junction means connected to a higher order mode coupler, a second junction, a first set of dummy ports, and to a low frequency modular area;

wherein the higher order mode coupler comprises a tracking port;

wherein the low frequency modular area comprises a low frequency filter, a low frequency polarizer, a low frequency hybrid tee, and low frequency ports;

wherein an interface between the first common junction means and the second junction functions as a high pass filter;

the second junction connected to the first common junction means, to a second set of dummy ports, and to a high frequency modular area;

wherein the high frequency modular area comprises a high frequency polarizer, a high frequency hybrid tee, and high frequency ports;

wherein all components of the higher order mode coupler, the first common junction means, the second junction, the first set of dummy ports, the second set of dummy ports, the low frequency modular area, and the high frequency modular area are built in a modular split block configuration; and wherein the modular split block configuration comprises a plurality of split blocks.

6. The assembly of claim 5, wherein all components of the higher order mode coupler, the first common junction means, the second junction, the first set of dummy ports, the second set of dummy ports, the low frequency modular area, and the high frequency modular area are split along respective zero current lines when the split blocks are separated.

7. A multilayered assembly forming a microwave feed network, the assembly comprising:

a first common junction means functioning to provide an input/output area;

the first common junction means connected to a second junction, a first set of dummy ports, and to a low frequency modular area;

wherein the low frequency modular area comprises a low pass filter, and a first quadrature hybrid;

wherein an interface between the first common junction means and the second junction functions as a high pass filter;

the second junction connected to the first common junction means, a high frequency modular area, and a second set of dummy ports;

wherein the high frequency modular area comprises a second quadrature hybrid;

wherein all components of the first common junction means, the second junction, the first set of dummy ports, the second set of dummy ports, the low frequency modular area, and the high frequency modular area are built in a modular split block configuration; and wherein the modular split block configuration comprises a plurality of split blocks.

8. The assembly of claim 7, wherein all components of the first common junction means, the second junction, the first set of dummy ports, the second set of dummy ports, the low frequency modular area, and the high frequency modular area are split along respective zero current lines when the split blocks are separated.

9. A multilayered assembly forming a microwave feed network, the assembly comprising:

a lowest frequency module comprising a lowest frequency common junction means, a lowest set of dummy ports, a lowest pass filter, a lowest frequency polarizer, a lowest frequency hybrid tee, and lowest frequency ports;

a highest frequency module comprising a highest frequency junction, a highest set of dummy ports, a highest frequency polarizer, a highest frequency hybrid tee, and highest frequency ports;

one or more intermediate modules connected in series between the lowest frequency module and the highest frequency module;

wherein each said intermediate module is tuned to operate at a pre-selected frequency range;

wherein each said intermediate module comprises a common junction means, a set of dummy ports, a low pass filter, a polarizer, a hybrid tee, and ports;

wherein an interface between each said intermediate module functions as a high pass filter;

wherein the lowest frequency module, the highest frequency module, and the one or more intermediate modules are built in a modular split block configuration; and wherein the modular split block configuration comprises a plurality of split blocks.

10. The assembly of claim 9, wherein all components of the lowest frequency module, the highest frequency module, and the one or more intermediate modules are split along respective zero current lines when the split blocks are separated.

11. A multilayered assembly forming a microwave feed network, the assembly comprising:

a lowest frequency module comprising a lowest frequency common junction, a lowest set of dummy ports, a lowest pass filter, and a lowest frequency quadrature hybrid;

a highest frequency module comprising a highest frequency junction, a highest set of dummy ports, and a highest frequency quadrature hybrid;

one or more intermediate modules connected in series between the lowest frequency module and the highest frequency module;

wherein each said intermediate module is tuned to operate at a preselected frequency range;

wherein each said intermediate module comprises a common junction, a set of dummy ports, a low pass filter, and a quadrature hybrid;

wherein an interface between each said intermediate module functions as a high pass filter;

wherein the lowest frequency module, the highest frequency module, and the one or more intermediate modules are built in a modular split block configuration; and wherein the modular split block configuration comprises a plurality of split blocks fastened together without flanges.

12. The assembly of claim 11, wherein all components of the lowest frequency module, the highest frequency module, and the one or more intermediate modules are split along respective zero current lines when the split blocks are separated.

13. A microwave feed network comprising:

a plurality of plates each having planar surfaces;

a contiguous joining of a plurality of co-planar surfaces forming recesses in the plates;

wherein the recesses form the microwave feed network;

the microwave feed network comprising:

a first common junction for receiving/sending microwave signals;

the first common junction connected to a second junction and to a low frequency modular area;

wherein the low frequency modular area comprises a low pass filter and low frequency ports;

wherein an interface between the first common junction and the second junction functions as a high pass filter;

the second junction connected to the first common junction and to a high frequency modular area; and wherein the high frequency modular area comprises high frequency ports.

14. A contiguous joining of co-planar surfaces of adjoined plates forming a microwave feed network in recesses in the plates, wherein the microwave feed network comprises:

a first common junction;

the first common junction connected to a second junction, to a first set of dummy ports, and to a low frequency modular area;

wherein the low frequency modular area comprises a low pass filter and a first quadrature hybrid;

wherein an interface between the first common junction and the second junction functions as a high pass filter;

the second junction connected to the first common junction, a second set of dummy ports, and to a high frequency modular area; and wherein the high frequency modular area comprises a second quadrature hybrid.

15. A multilayered assembly forming a microwave feed network, the assembly comprising:

a plurality of blocks having recesses;

wherein the blocks are joinable to each other in a coplanar manner;

wherein the recesses form a plurality of waveguides when the blocks are joined in the coplanar manner; and wherein the assembly comprises one or more common junctions, a junction, one or more dummy ports, one or more filters, one or more polarizers, one or more hybrid tees, and one or more ports.

16. The assembly of claim 15, wherein the plurality of waveguides are split along zero current lines when the blocks are separated from each other.

17. A multilayered assembly forming a microwave feed network, the assembly comprising:

a first common junction means functioning to route microwave signals;

a low pass filter means functioning to pass a predetermined low frequency range of microwave signals;

a high pass filter means functioning to pass a predetermined high frequency range of microwave signals;

a first dummy port means functioning to create a first symmetrical structure;

wherein the first common junction means is connected to the low pass filter means, the first dummy port means, and the high pass filter means;

a first quadrature hybrid means functioning to polarize and combine microwave signals;

wherein the first quadrature hybrid means is connected to the low pass filter means;

a second junction means functioning to route microwave signals;

a second dummy port means functioning to create a second symmetrical structure;

a second quadrature hybrid means functioning to polarize and combine microwave signals;

wherein the second junction means is connected to the high pass filter means, the second dummy port means, and the second quadrature hybrid means;

wherein all components of the first common junction means, the second junction means, the first dummy port means, the low pass filter means, the first quadrature hybrid means, the high pass filter means, the second junction means, the second dummy port means, and the second quadrature hybrid means are built in a modular split block configuration; and wherein the modular split block configuration comprises a plurality of split blocks.

18. A process of producing a microwave feed network with a minimal axial length, the process comprising the steps of:

selecting waveguide components to be produced in a modular split block configuration;

wherein the modular split block configuration comprises a plurality of split blocks;

grouping the waveguide components into frequency modular areas;

wherein each said frequency modular area comprises a filter and a port;

arranging a layout of the frequency modular areas within the split blocks such that the frequency modular areas are placed in an ascending order with respect to a frequency modular areas' frequency range;

placing the frequency modular area with a lowest frequency range closest to a horn connection point;

forming the split blocks such that the split blocks may be joined together without the use of flanges; and forming the split blocks such that the waveguide components are split along their respective zero current lines when the split blocks are separated.

19. The process of claim 18, wherein the waveguide components to be produced in the modular split block configuration further comprise one or more common junctions, one or more low pass filters, one or more polarizers, one or more hybrid tees, one or more high pass filters, one or more dummy ports, and one or more junctions.

20. The process of claim 18, wherein the waveguide components to be produced in the modular split block configuration further comprise one or more common junctions, one or more low pass filters, one or more quadrature hybrids, one or more high pass filters, one or more dummy ports, and one or more junctions.

* * * * *